US008652748B2

(12) United States Patent
Suzuki et al.

(10) Patent No.: US 8,652,748 B2
(45) Date of Patent: Feb. 18, 2014

(54) PROCESS FOR PRODUCING A TONER FOR ELECTROPHOTOGRAPHY

(75) Inventors: Manabu Suzuki, Wakayama (JP); Hiroshi Mizuhata, Wakayama (JP)

(73) Assignee: Kao Corporation, Tokyo (JP)

( * ) Notice: Subject to any disclaimer, the term of this patent is extended or adjusted under 35 U.S.C. 154(b) by 7 days.

(21) Appl. No.: 13/517,362

(22) PCT Filed: Dec. 22, 2010

(86) PCT No.: PCT/JP2010/073864
§ 371 (c)(1),
(2), (4) Date: Jun. 20, 2012

(87) PCT Pub. No.: WO2011/078410
PCT Pub. Date: Jun. 30, 2011

(65) Prior Publication Data

US 2012/0251940 A1 Oct. 4, 2012

(30) Foreign Application Priority Data

Dec. 22, 2009 (JP) ..... 2009-290423
Jul. 15, 2010 (JP) ..... 2010-160964

(51) Int. Cl.
*G03G 5/00* (2006.01)

(52) U.S. Cl.
USPC ..... 430/137.14; 430/137.11

(58) Field of Classification Search
USPC ..... 430/110.2, 137.11, 137.14
See application file for complete search history.

(56) References Cited

U.S. PATENT DOCUMENTS

| | | | | |
|---|---|---|---|---|
| 7,727,699 | B2 | 6/2010 | Kamiyoshi et al. | |
| 8,114,564 | B2 | 2/2012 | Kamiyoshi et al. | |
| 2008/0131804 | A1* | 6/2008 | Kamiyoshi et al. | 430/110.2 |
| 2008/0233508 | A1* | 9/2008 | Kamiyoshi et al. | 430/110.3 |
| 2009/0004589 | A1 | 1/2009 | Yuasa et al. | |
| 2009/0035682 | A1 | 2/2009 | Shima et al. | |
| 2011/0223531 | A1 | 9/2011 | Mizuhata et al. | |

FOREIGN PATENT DOCUMENTS

| | | |
|---|---|---|
| JP | 8 20636 | 1/1996 |
| JP | 10 207125 | 8/1998 |
| JP | 10 239903 | 9/1998 |
| JP | 11 133668 | 5/1999 |
| JP | 2000 131882 | 5/2000 |
| JP | 2001 305789 | 11/2001 |
| JP | 2003 66646 | 3/2003 |
| JP | 2008 268565 | 11/2008 |
| JP | 2009-79207 | 4/2009 |

OTHER PUBLICATIONS

International Search Report Issued Apr. 29, 2011 in PCT/JP10/73864 Filed Dec. 22, 2010.
Office Action issued on Mar. 15, 2013 in the corresponding Chinese Patent Application No. 201080057495.1.

* cited by examiner

*Primary Examiner* — Stewart Fraser
(74) *Attorney, Agent, or Firm* — Oblon, Spivak, McClelland, Maier & Neustadt, L.L.P.

(57) ABSTRACT

The invention provides a process for producing a toner for electrophotography including the following (1) to (4): (1): adding an aggregating agent to a resin particle dispersion (a) so as to attain an aggregating agent concentration Ea (wt %), to thereby produce an aggregated particle dispersion (A); (2): adding a resin microparticle dispersion (b) to the dispersion (A), to thereby produce a dispersion (B) having an aggregating agent concentration Eb (wt %) satisfying $0.60 \leq Eb/Ea < 1$; (3): modifying the aggregating agent concentration of the dispersion (B), to thereby produce a dispersion (C) of resin microparticle-deposited aggregated particles, having an aggregating agent concentration Ec (wt %) satisfying $0 < Ec/Ea \leq 0.30$; and (4): heating the resin microparticle-deposited aggregated particles in the dispersion (C) at a temperature falling within a range between Tg and Tg+20 (0 C) of the resin microparticles in the resin microparticle dispersion (b), to thereby coalesce the aggregated particles.

16 Claims, No Drawings

PROCESS FOR PRODUCING A TONER FOR ELECTROPHOTOGRAPHY

TECHNICAL FIELD

The present invention relates to a process for producing a toner for electrophotography, and to a toner for electrophotography produced through the process. More particularly, the invention relates to a process for producing a toner for electrophotography for use in an electrophotographic method, an electrostatic recording method, an electrostatic printing method, or the like, and to a toner for electrophotography produced through the process.

BACKGROUND ART

In the field of toners for electrophotography, with the progress of electrophotographic systems, there has been demand to develop toners having enhanced storage stability, stability in the environment, image-transferability, etc.

Patent Document 1 discloses a method for hydrophobicizing the surfaces of chemical prepared toner particles, wherein, during production of a chemical prepared toner having a core/shell structure, shell particles are deposited on core particles through encapsulation without adding a metal salt.

Patent Document 2 discloses a method for improving the image-transferability and storage stability of a chemical prepared toner, wherein, during production of the chemical prepared toner, inorganic microparticles are caused to deposit on aggregated particles formed in advance, and the thus-modified particles are coalesced, to thereby form particles on which inorganic microparticles are uniformly deposited.

Meanwhile, chemical prepared toners encounter difficulty in receiving shear by mechanical means (e.g., kneading), resulting in poor dispersion. This impairs the storage stability of the toners. Thus, Patent Document 3 discloses a technique of employing two or more metal salts having different valencies as aggregating agents in the production of a chemical prepared toner, for attaining good storage stability and tribocharge stability in the environment.

Patent Document 4 discloses a method for producing a chemical prepared toner, wherein, in production of the chemical prepared toner, the aggregating agent concentration is caused to vary at hot-melt-bonding in order to attain satisfactory chargeability. Patent Document 5 also discloses a method for producing a chemical prepared toner, wherein, an aggregating agent having a valency of 2 or more is employed in production of the chemical prepared toner, in order to attain satisfactory image-transferability.

PRIOR ART DOCUMENT

Patent Document

Patent Document 1: JP-A-2008-268565
Patent Document 2: JP-A-10-207125
Patent Document 3: JP-A-2003-66646
Patent Document 4: JP-A-2000-131882
Patent Document 5: JP-A-2001-305789

SUMMARY OF INVENTION

Technical Problem

However, the aforementioned techniques disclosed in Patent Documents 1 to 5 require further improvement, since the storage stability, tribocharge stability in the environment, and low incidence of toner cloud of the produced toners are unsatisfactory, and the toners fail to have both high storage stability and high image-transferability.

The present invention is directed to a process for producing a toner for electrophotography at least having improved storage stability.

The present invention is also directed to a process for producing a toner for electrophotography having improved storage stability, tribocharge stability in the environment, and low incidence of toner cloud of the toner.

The present invention is further directed to a process for producing a toner for electrophotography having improved storage stability and image-transferability of the toner.

Solution to Problem

Accordingly, the present invention provides the following [1] to [5]. [1] A process for producing a toner for electrophotography containing the following steps (1) to (4):

step (1): adding an aggregating agent to a resin particle dispersion (a) so as to attain an aggregating agent concentration Ea (% by weight), to thereby aggregate resin particles in the resin particle dispersion (a), whereby an aggregated particle dispersion (A) is produced;

step (2): adding a resin microparticle dispersion (b) to the aggregated particle dispersion (A) produced in step (1), to thereby produce a dispersion (B) of resin microparticle-deposited aggregated particles having an aggregating agent concentration Eb (% by weight) satisfying the following formula 1:

$$0.60 \leq Eb/Ea < 1 \quad \text{(formula 1);}$$

step (3): modifying the aggregating agent concentration of the dispersion (B) of resin microparticle-deposited aggregated particles produced in step (2), to thereby produce a dispersion (C) of resin microparticle-deposited aggregated particles, having an aggregating agent concentration Ec (% by weight) satisfying the following formula 2:

$$0 < Ec/Ea \leq 0.30 \quad \text{(formula 2); and}$$

step (4): heating the resin microparticle-deposited aggregated particles in the dispersion (C) of resin microparticle-deposited aggregated particles having the aggregating agent concentration Ec and produced in step (3) at a temperature falling within a range between a glass transition point Tg (° C.) of the resin microparticles in the resin microparticle dispersion (b) and (Tg+20) (° C.), to thereby coalesce the aggregated particles.

[2] The process for producing the toner for electrophotography as described in [1] above, wherein the aggregating agent concentration Ec in step (3) satisfies the following formula 2-1:

$$0.08 < Ec/Ea \leq 0.30 \quad \text{(formula 2-1).}$$

[3] The process for producing the toner for electrophotography as described in [1] above, wherein the aggregating agent concentration Ec in step (3) satisfies the following formula 2-2:

$$0.005 \leq Ec/Ea \leq 0.08 \quad \text{(formula 2-2).}$$

[4] The process for producing the toner for electrophotography as described in [1] above, wherein step (3) further includes the following steps (3-1) and (3-2):

step (3-1): maintaining the dispersion (B) of resin microparticle-deposited aggregated particles produced in step (2) at a temperature which is equal to or higher than a temperature lower by 10° C. than a glass transition point of an amorphous polyester (b) contained in the resin microparticles in the resin microparticle dispersion (b), to thereby produce a core/shell particle dispersion (1) having an aggregating agent concentration of 0.05 to 0.40 mol/L and a particle circularity of 0.920 to 0.970; and step (3-2): removing at least a part of the aggregating agent from the core/shell particle dispersion (1) produced in step (3-1), to thereby produce a dispersion (C) of resin microparticle-deposited aggregated particles having the aggregating agent concentration Ec, and a core/shell particle dispersion (3) having a particle circularity of 0.950 to 0.980 is produced after coalescence performed in step (4), wherein the circularity of the particles contained in the core/shell particle dispersion (3) is greater by 0.005 or more than that of the particles contained in the core/shell particle dispersion (1).

[5] A toner for electrophotography produced through the process as recited in [1] above.

Hereinafter, the process as recited in [2] above is referred to as a "first embodiment of the present invention", the process as recited in [3] above is referred to as a "second embodiment of the present invention", and the process as recited in [4] above is referred to as a "third embodiment of the present invention".

Advantageous Effects of Invention

The present invention can provide a process for producing a toner for electrophotography at least having improved storage stability.

The present invention also can provide a process for producing a toner for electrophotography having improved storage stability, improved tribocharge stability in the environment, and preventing toner cloud (the first embodiment of the present invention).

The present invention also can provide a process for producing a toner for electrophotography having improved storage stability and improved image-transferability (the second embodiment of the present invention).

The present invention also can provide a toner for electrophotography which has excellent low-temperature fusing ability and excellent storage stability and which suppresses toner cloud, and provision of a process for producing the toner (the third embodiment of the present invention).

DESCRIPTION OF EMBODIMENTS

Process for Producing Toner for Electrophotography

The process of the invention for producing a toner for electrophotography includes the following steps (1) to (4):

step (1): adding an aggregating agent to a resin particle dispersion (a) so as to attain an aggregating agent concentration Ea (% by weight), to thereby aggregate resin particles in the resin particle dispersion (a), whereby an aggregated particle dispersion (A) is produced;

step (2): adding a resin microparticle dispersion (b) to the aggregated particle dispersion (A) produced in step (1), to thereby produce a dispersion (B) of resin microparticle-deposited aggregated particles having an aggregating agent concentration Eb (% by weight) satisfying the following formula 1:

$$0.60 \leq Eb/Ea < 1 \quad \text{(formula 1);}$$

step (3): modifying the aggregating agent concentration of the dispersion (B) of resin microparticle-deposited aggregated particles produced in step (2), to thereby produce a dispersion (C) of resin microparticle-deposited aggregated particles, having an aggregating agent concentration Ec (% by weight) satisfying the following formula 2:

$$0 < Ec/Ea \leq 0.30 \quad \text{(formula 2); and}$$

step (4): heating the resin microparticle-deposited aggregated particles in the dispersion (C) of resin microparticle-deposited aggregated particles having the aggregating agent concentration Ec and produced in step (3) at a temperature falling within a range between a glass transition point Tg (° C.) of the resin microparticles in the resin microparticle dispersion (b) and (Tg+20) (° C.), to thereby coalesce the aggregated particles.

According to the present invention, in the production of a chemical prepared toner, a resin microparticle dispersion is added to an aggregated particle dispersion having a predetermined aggregating agent concentration, to thereby produce a dispersion of resin microparticle-deposited aggregated particles, and then the aggregating agent concentration is further reduced. Quite surprisingly, the storage stability of the obtained toner is improved, and the tribocharge stability in the environment, the low incidence of toner cloud, the image-transferability, etc. can be improved.

Particularly, a chemical prepared toner, which is produced through emulsification aggregation in an aqueous system, hydrophilic groups of the binder resin tend to orient toward the surfaces of the toner particles, to thereby hydrophilicize the toner particles. Furthermore, since the emulsification aggregation method generally includes a step of coalescing aggregated particles, the temperature in the system must be maintained at a temperature higher than the glass transition point of the resin in order to fully complete coalescing of the surfaces of the aggregated particles. As a result, molecular chains of the binder resin more readily move, and orientation of hydrophilic groups toward the surfaces of the obtained toner particles is promoted, whereby the tribocharge stability in the environment is impaired, and toner characteristics such as generation of toner cloud, image-transferability, etc. are impaired. In contrast, when the coalescing temperature is lowered to solve the aforementioned problems, coalescing is insufficient, and the storage stability of the toner is impaired. However, in the present invention, a dispersion of resin microparticle-deposited aggregated particles is produced at a specific aggregating agent concentration, and then the aggregating agent concentration is reduced to a certain level. Through this procedure, the coalescing temperature can be lowered, and surprisingly, the storage stability of the produced toner can be improved, although the reason therefor has not been clearly elucidated.

[Step (1)]

In step (1), an aggregating agent is added to a resin particle dispersion (a) so as to attain an aggregating agent concentration Ea (% by weight), to thereby aggregate resin particles in the resin particle dispersion (a), whereby an aggregated particle dispersion (A) is produced.

(Resin Particle Dispersion (a))

The resin forming the resin particles in the resin particle dispersion (a) may be a known resin employed for forming toners, and example thereof include polyester, styrene-acrylic copolymer, epoxy resin, polycarbonate, and polyurethane. In order to ensure the storage stability, fusing ability, and durability of the toner, polyester is preferably contained. To attain good storage stability, fusing ability, and durability of the toner, the polyester content of the resin is preferably 60% by weight or more, more preferably 70% by weight or more, still more preferably 80% by weight or more, yet more preferably substantially 100% by weight.

No particular limitation is imposed on the monomer of the polyester, and a known alcohol component and a known carboxylic acid component such as a carboxylic acid, a carboxylic acid anhydride, and a carboxylic acid ester are employed.

Examples of the carboxylic acid include dicarboxylic acids such as phthalic acid, isophthalic acid, terephthalic acid, fumaric acid, maleic acid, adipic acid, succinic acid, oxalic acid, malonic acid, citraconic acid, itaconic acid, glutaconic acid, sebacic acid, 1,12-dodecanedioic acid, and azelaic acid; divalent carboxylic acids such as substituted succinic acids (with a C1 to C20 alkyl group or a C2 to C20 alkenyl group) such as dodecenylsuccinic acid and octenyl succinic acid; trivalent or higher valent polycarboxylic acids such as trimellitic acid and pyromellitic acid; anhydrides thereof, and alkyl (C1 to C3) esters thereof.

The dicarboxylic acid is preferably terephthalic acid. Specific examples of preferred substituted succinic acids substituted with a C1 to C20 alkyl group or a C2 to C20 alkenyl group include dodecenylsuccinic acid. The trivalent or higher valent polycarboxylic acid is preferably trimellitic acid.

These carboxylic acid components may be used singly or in combination of two or more species.

Examples of the alcohol component include aliphatic diols (C2 to C12 backbone), aromatic diols, bisphenol A hydrogenated products, and polyhydric alcohols having a valency of 3 or higher. Specific examples of the alcohol component include alkylene (C2 or C3) oxide adducts (average molar number of addition: 1 to 16) of bisphenol A such as polyoxypropylene-2,2-bis(4-hydroxyphenyl)propane and polyoxyethylene-2,2-bis(4-hydroxyphenyl)propane; and hydrogenated bisphenol A, ethylene glycol, propylene glycol, neopentyl glycol, 1,4-butanediol, 1,3-butanediol, 1,6-hexanediol, 1,7-heptanediol, 1,8-octanediol, 1,9-nonanediol, 1,10-decanediol, 1,12-dodecanediol, glycerin, pentaerythritol, trimethylol propane, sorbitol, and alkylene (C2 to C4) oxide adducts (average molar number of addition: 1 to 16) of these compounds. These alcohols may be used singly or in combination of two or more species.

The polyester may be produced, for example, by polycondensing the alcohol component and the carboxylic acid component in an inert gas atmosphere at about 180 to about 250° C., if required, in the presence of an esterification catalyst.

As an esterification catalyst, there may be employed tin compounds such as dibutyltin oxide and tin dioctylate, and titanium compounds such as titanium diisopropylate bistriethanolaminate, for ensuring the efficiency of polycondensation reaction. No particular limitation is imposed on the amount of the esterification catalyst used, and the amount is preferably 0.01 to 1 part by weight, more preferably 0.1 to 0.6 parts by weight, on the basis of 100 parts by weight of the sum of the alcohol component and the carboxylic acid component.

In order to attain good stability of the resultant toner, the polyester preferably has a softening point of 70 to 165° C., more preferably 90 to 165° C. The glass transition point is preferably 50 to 85° C., more preferably 55 to 85° C. The acid value of the polyester is preferably 6 to 35 mg-KOH/g, more preferably 10 to 35 mg-KOH/g, even more preferably 15 to 35 mg-KOH/g, from the viewpoint of productivity. The softening point or the acid value of the polyester may be desirably adjusted by controlling the ratio of alcohol/carboxylic acid and the temperature and time of the polycondensation reaction.

Meanwhile, in the present invention, as the polyester, there may be employed not only an unmodified polyester but also a modified polyester obtained by modifying polyesters to such an extent that the polyesters are substantially free from deterioration in inherent properties thereof. Examples of the modified polyester include polyesters grafted or blocked with phenol, urethane, epoxy, etc., through the methods described, for example, in JP-A-11-133668, JP-A-10-239903, and JP-A-8-20636, and composite resins containing two or more kinds of resin units including a polyester unit.

Meanwhile, when the resin particles in the resin particle dispersion (a) contain a plurality of resins, the softening point, glass transition point, acid value, and number average molecular weight of the resin forming the resin particles all mean those characteristic values of a mixture of these resins. The respective characteristic values of the mixture are preferably the same as the corresponding values of the polyesters.

Further, for ensuring good storage stability, fusing ability, and durability of the toner, the resin may contain two kinds of polyesters which are different in softening point from each other. One polyester (I) preferably has a softening point of not lower than 70° C. but lower than 115° C., and the other polyester (II) preferably has a softening point of 115 to 165° C. The weight ratio of the polyester (I) to the polyester (II) (I/II) in the resin binder is preferably 10/90 to 90/10, more preferably 50/50 to 90/10.

In the present invention, the resin forming the resin particles is preferably dispersed in an aqueous medium. The aqueous medium in which the resin is dispersed contains water as a main component. From the viewpoint of environmental suitability, the water content of the aqueous medium is preferably 80% by weight or more, more preferably 90% by weight or more, most preferably 100% by weight. The water is preferably deionized water or distilled water.

Examples of the component other than water include water-soluble organic solvents; i.e., alcoholic organic solvents such as methanol, ethanol, isopropanol, and butanol; dialkyl (C1 to C3) ketones such as acetone and methyl ethyl ketone; cyclic ethers such as tetrahydrofuran. Among these organic solvents, for reducing inclusion into the toner, preferred are alcoholic organic solvents incapable of dissolving resins therein such as methanol, ethanol, isopropanol, and butanol. In the present invention, the resin is preferably dispersed in water solely to form microparticles thereof, using substantially no organic solvent.

In addition to the aforementioned resin, the resin particle dispersion (a) in which the resin is dispersed may further contain, if required, additives such as a colorant, a releasing agent, and a charge-controlling agent.

Examples of the releasing agent include paraffin wax, rice wax, fatty acid amide wax, fatty acid wax, aliphatic monoketones, fatty acid metal salt wax, fatty acid ester wax, partially saponified fatty acid ester wax, silicone varnish, higher alcohol, and carnauba wax, which are all solid. Alternatively, a polyolefin such as low-molecular-weight polyethylene or polypropylene may also be used. These releasing agents may be used singly or in combination of two or more species.

For ensuring the fusing ability of the toner, the releasing agent preferably has a melting point of 60 to 90° C., more preferably 65 to 90° C. In particular, to attain low-temperature fusing ability of the toner, a paraffin wax having a melting point of 60 to 90° C. is preferred. Among them, carnauba wax is further more preferred. To attain compatibility with polyester, an ester-based wax having a melting point of 60 to 90° C. is more preferred.

For ensuring dispersibility in resin and toner fusing ability, the releasing agent content is preferably 0.5 to 20 parts by weight, more preferably 1 to 18 parts by weight, still more preferably 1.5 to 15 parts by weight, based on the 100 parts by weight of the resin.

The present invention is advantageous, particularly when the toner contains a releasing agent, since a problematic bleed out which would otherwise be caused by a releasing agent can be prevented.

No particularly limitation is imposed on the colorant, and any known colorants may be used. Either a pigment or a dye may be used as the colorant, but a pigment is preferred for ensuring high image density given by the toner. Specific examples of the pigment include carbon black, inorganic composite oxides, Chrome Yellow, Benzidine Yellow, Pyrazolone. Orange, Vulcan Orange, Watchung Red, Brilliant Carmine 3B, Brilliant Carmine 6B, Lake Red C, Bengal, Aniline Blue, Ultramarine Blue, Phthalocyanine Blue, and Phthalocyanine Green. Specific examples of the dye include acridine dyes, azo dyes, benzoquinone dyes, azine dyes, anthraquinone dyes, indigo dyes, thioindigo dyes, phthalocyanine dyes, and Aniline Black dyes. These colorants may be used alone or in combination of any two or more thereof.

The colorant content is preferably 20 parts by weight or less, more preferably 0.01 to 10 parts by weight, on the basis of 100 parts by weight of the resin.

Examples of the charge-controlling agent include metal salts of benzoic acid, metal salts of salicylic acid, metal salts of alkylsalicylic acids, metal salts of catechol, metal-containing bisazo dyes, and quaternary ammonium salts. These agents may be used singly or in combination of two or more species.

The charge-control agent content is preferably 10 parts by weight or less, more preferably 0.01 to 5 parts by weight, on the basis of 100 parts by weight of the resin.

In the present invention, upon production of the resin particle dispersion (a), for ensuring good dispersion stability of the resin, etc., a surfactant is preferably caused to be present therein in an amount of 10 parts by weight or less, more preferably 5 parts by weight or less, still more preferably 0.1 to 3 parts by weight, even more preferably 0.5 to 2 parts by weight on the basis of 100 parts by weight of the resin.

Examples of the surfactant include anionic surfactants such as sulfate-based surfactants, sulfonate-based surfactants, and soap-based surfactants; cationic surfactants such as amine salt-type surfactants and quaternary ammonium salt-type surfactants; and nonionic surfactants such as polyethylene glycol-based surfactants, alkyl phenol ethylene oxide adduct-based surfactants, and polyhydric alcohol-based surfactants. Among these surfactants, preferred are ionic surfactants such as anionic surfactants and cationic surfactants. The nonionic surfactant is preferably used in combination with an anionic surfactant or a cationic surfactant. These surfactants may be used alone or in combination of any two or more thereof.

Specific examples of the anionic surfactant include dodecylbenzenesulfonic acid, sodium dodecylbenzenesulfonate, sodium dodecyl sulfate, and sodium alkyl ether sulfates. Of these, sodium dodecylbenzenesulfonate and sodium alkyl ether sulfates are preferred, for stabilizing the resin in emulsion.

Specific examples of the cationic surfactant include alkylbenzenedimethylammonium chlorides, alkyltrimethylammonium chlorides, and distearylammonium chloride.

Examples of the nonionic surfactant include polyoxyethylene alkyl aryl ethers and polyoxyethylene alkyl ethers such as polyoxyethylene nonylphenyl ether, polyoxyethylene oleyl ether, and polyoxyethylene lauryl ether; polyoxyethylene fatty esters such as polyethylene glycol monolaurate, polyethylene glycol monostearate, and polyethylene glycol monooleate; and oxyethylene/oxypropylene block copolymers. Of these, polyoxyethylene alkyl ethers are preferred, for stabilizing the resin in emulsion.

Also, in the preparation of the resin particle dispersion (a), preferably, an aqueous alkali solution is added to the resin, and the resin is dispersed together with an optional additive.

The aqueous alkali solution preferably has a concentration of 1 to 20% by weight, more preferably 1 to 10% by weight, still more preferably 1.5 to 7.5% by weight. As the alkali of the aqueous alkali solution, preferably used is such an alkali that allows a salt of the resin to exhibit an enhanced surface activity. Specific examples of the alkali include hydroxides of a monovalent alkali metal such as potassium hydroxide and sodium hydroxide.

After dispersing the resin in the aqueous medium, preferably, the resin is neutralized at a temperature not lower than the glass transition point of the resin, and then an aqueous medium is added thereto at a temperature not lower than the glass transition point of the resin, to thereby emulsify the resin, whereby the resin particle dispersion (a) is produced.

The rate of addition of the aqueous medium is preferably 0.1 to 50 g/min, more preferably 0.5 to 40 g/min, still more preferably 1 to 30 g/min per 100 g of the resin, for effectively conducting the emulsifying step. The rate of addition of the aqueous medium may be generally maintained until an 0/W type emulsion is substantially formed. Therefore, the rate of addition of the aqueous medium after forming the 0/W type emulsion is not particularly limited.

Examples of the aqueous medium employed in production of the resin emulsion include the same aqueous media as employed in dispersion of the resin to form the aforementioned resin particles. Among these aqueous media, preferred are deionized water and distilled water.

The amount of aqueous medium is preferably 100 to 2,000 parts by weight, more preferably 150 to 1,500 parts by weight, on the basis of 100 parts by weight of the resin, for obtaining uniform aggregated particles in the subsequent aggregating treatment. The amount of aqueous medium is controlled such that the solid content of the thus-prepared resin emulsion is preferably adjusted to 7 to 50% by weight, more preferably 7 to 40% by weight, still more preferably 10 to 35% by weight, for ensuring the stability of the resultant resin emulsion and the handling property of the resin emulsion. Notably, the solid components include nonvolatile components such as resins and a nonionic surfactant.

In order to prepare a resin emulsion containing finely-dispersed resin particles, the above emulsification is preferably conducted at a temperature not lower than the glass transition point of the resin and not higher than the softening point thereof. When the emulsification is conducted in the above-specified temperature range, the resin can be smoothly emulsified in the aqueous medium, and any special apparatus is not required for heating. From these viewpoints, the temperature used for the emulsification is preferably not lower than a temperature which is higher by 10° C. than the glass transition point of the resin (such a temperature is hereinafter referred to as "glass transition point of the resin+(plus) 10"C", and the same is applied throughout the specification) and not higher than a temperature which is lower by 5° C. than the softening point of the resin (such a temperature is hereinafter referred to as "softening point of the resin−(minus) 5"C").

The volume-median particle size ($D_{50}$) of the resin particles contained in the resin particle dispersion (a) is preferably 0.02 to 2 μm, more preferably 0.05 to 1 μm, still more preferably 0.05 to 0.6 μm, for the purpose of uniform aggregation thereof in the subsequent aggregating step. Meanwhile, the volume-median particle size ($D_{50}$) used herein means a particle size at which a cumulative volume frequency calculated on the basis of a volume fraction of particles from a smaller particle size side thereof is 50%.

As an alternative method for obtaining the resin particle dispersion (a), there may be employed, for example, a method of emulsifying and dispersing a polycondensable monomer as a raw material of target resin particles in an aqueous medium, for example, through applying a mechanical shearing force or an ultrasonic wave thereto. In this method, if required, additives such as a polycondensation catalyst and a surfactant may also be added to the aqueous medium. The polycondensation reaction of the monomer is allowed to proceed, for example, by heating the obtained mixture. For example, when a polyester is used as the resin, there may be used polycondensable monomers and a polycondensation catalyst for producing the above polyesters, and as the surfactant, there may also be used those as described above.

Generally, polymerization of polycondensable monomers for producing a polycondensed resin is accompanied with a dehydration reaction thereof and, therefore, does not principally proceed in an aqueous medium. However, for example, when a polycondensable monomer is emulsified in the aqueous medium in the presence of a surfactant capable of forming a micelle in the aqueous medium, the monomer is present in a micro hydrophobic site in the micelle and is subjected to dehydration reaction to produce water. By discharging the thus-produced water into the aqueous medium outside of the micelle, polymerization of the monomer can proceed. Thus, it is possible to produce the target dispersion by emulsifying and dispersing polycondensed resin particles in the aqueous medium even under energy-saving conditions.

(Aggregated Particle Dispersion (A))

In step (1), an aggregating agent is added to a resin particle dispersion (a) so as to attain an aggregating agent concentration Ea (% by weight), to thereby aggregate resin particles in the resin particle dispersion (a), whereby an aggregated particle dispersion (A) is produced (hereinafter step (1) may be referred to as "aggregation step").

In the present invention, as an aggregating agent, an organic aggregating agent such as an organic salt (e.g., a quaternary salt-type cationic surfactant) or polyethyleneimine, or an inorganic aggregating agent such as an inorganic metal salt, an inorganic ammonium salt, or a metal complex, is employed. Examples of the organic salt include sodium acetate and ammonium acetate. Examples of the inorganic metal salt include metal salts such as sodium sulfate, sodium chloride, calcium chloride, calcium nitrate, magnesium chloride, aluminum chloride, and aluminum sulfate; and inorganic metal salt polymers such as polyaluminum chloride and polyaluminum hydroxide. Examples of the inorganic ammonium salt include ammonium sulfate, ammonium chloride, and ammonium nitrate. Of these, ammonium sulfate is preferred.

In the present invention, for controlling a particle size of the toner with high accuracy and achieving a sharp particle size distribution thereof, among the aforementioned aggregating agents, a monovalent salt is preferably used. As uses herein, the "monovalent salt" means that a valence of a metal ion or a cation constituting the salt is 1. The monovalent salt serving as an inorganic aggregating agent is an inorganic metal salt, an ammonium salt, etc. In the present invention, among these aggregating agents, a water-soluble nitrogen-containing compound having a molecular weight of 350 or less is preferably used. As used herein, the term "water-soluble" in the "water-soluble nitrogen-containing compound" refers to having a solubility of 10% by weight or higher in water at 25° C.

A water-soluble nitrogen-containing compound having a molecular weight of 350 or less is preferably an acidic compound for ensuring rapid aggregation of the resin particles. The pH value of an aqueous solution containing 10% by weight of the water-soluble nitrogen-containing compound is preferably 4 to 6, more preferably 4.2 to 6, as measured at 25° C. Also, from the for attaining good charging property under high-temperature and high-humidity conditions, etc., the water-soluble nitrogen-containing compounds preferably have a molecular weight of 350 or less, more preferably 300 or less. Examples of the water-soluble nitrogen-containing compound include ammonium salts such as ammonium halides, ammonium sulfate, ammonium acetate, and ammonium salicylate; and quaternary ammonium salts such as tetraalkyl ammonium halides. For attaining good productivity, among these compounds, preferred are ammonium sulfate (pH value of 10 wt % aqueous solution at 25° C. (hereinafter referred to merely as a "pH"): 5.4), ammonium chloride (pH: 4.6), tetraethylammonium bromide (pH: 5.6), and tetrabutylammonium bromide (pH: 5.8).

In the present invention, the aforementioned aggregating agent is added so as to attain an aggregating agent concentration Ea (% by weight). The aggregating agent concentration Ea is calculated by the following formula.

$$Ea(\%\text{ by weight})=[\text{amount of aggregating agent added (g)}/\text{weight of aggregated particle dispersion}(A)\text{ (g)}]\times 100$$

As used herein, the term "weight of aggregated particle dispersion (A)" refers to the weight of the aggregated particle dispersion (A) after aggregation. Before aggregation, the term refers to the total weight of dispersion containing unaggregated resin particles and other additive particles, etc. During aggregation, the term refers to the total weight of dispersion containing unaggregated resin particles and other additive particles, etc. and dispersion (A).

The aggregating agent concentration during the aggregating step is preferably 0.0001 to 10 mol/L, for attaining good aggregation property. When the amount of aggregating agent is too small, resin particles cannot be aggregated, thereby failing to attain transformation of resin particles to toner particles, whereas when the amount of aggregating agent is excessive, the particle size of aggregated particles cannot be controlled, failing to yield a toner of interest. The aggregating agent concentration may vary depending on the valency of the aggregating agent. As described in "Up-to-date Colloid Chemistry" (Kitahara & Furusawa, 1990, published by Kodansha Scientific), since the aggregating property of resin particles is proportional to the six power of the valency of the aggregating agent, the aggregating agent concentration is adjusted so that the concentration preferably falls within a range of $0.1\times z^{-6}$ to $10\times z^{-6}$ (mol/L), more preferably $0.1\times z^{-6}$ to $1\times z^{-6}$ (mol/L), wherein z represents the valency of the aggregating agent.

As described above, the aggregating agent concentration varies depending on the valency of the aggregating agent. When a monovalent aggregating agent is used, the aggregating agent concentration Ea (% by weight) is preferably adjusted to 1 to 10% by weight, more preferably 1.5 to 8% by weight, still more preferably 2 to 5% by weight, with respect to the particle dispersion before aggregation, for controlling aggregation. When the aggregating agent concentration falls within the above ranges, aggregation is promoted, and formation of coarse particles is prevented, realizing easy control of particle size.

For ensuring the chargeability of the toner, particularly charging characteristics under high-temperature, high-humidity conditions, the amount of aggregating agent added is preferably adjusted to 50 parts by weight or less, more preferably 40 parts by weight or less, still more preferably 30 parts by weight or less, with respect to 100 parts by weight of the resin forming the resin particles in the resin particle dispersion (a). For ensuring the aggregating property, the amount of aggregating agent is preferably adjusted to 1 part by weight or more, more preferably 3 parts by weight or more, still more preferably 5 parts by weight or more, with respect to 100 parts by weight of the resin. In consideration of these factors, the amount of aggregating agent used is preferably adjusted to 1 to 50 parts by weight, more preferably 3 to 40 parts by weight, still more preferably 5 to 30 parts by weight, with respect to 100 parts by weight of the resin.

For ensuring the aggregating property and controlling the particle size distribution of aggregated particles, in step (1), the temperature Ta of the aggregation system (dispersion containing aggregating agent and resin particles and/or aggregated particles) is preferably controlled to a temperature which is not lower than [(glass transition point Tg of resin forming resin particles)−30)]° C. and not higher than [(glass transition point Tg of the rein)+25)]° C. When the temperature is controlled in the above manner, bonding of aggregated does not rapidly proceed, thereby preventing formation of coarse particles. Thus, for preventing formation of coarse particles, the temperature is preferably controlled to [(glass transition point Tg of resin forming resin particles)−30)]° C. to [(glass transition point Tg of the rein)+25)]° C., more preferably [(glass transition point Tg of resin forming resin particles)−25)]° C. to [(glass transition point Tg of the rein)+25)]° C., still more preferably [(glass transition point Tg of resin forming resin particles)−20)]° C. to [(glass transition point Tg of the rein)+15)]° C., yet more preferably [(glass transition point Tg of resin forming resin particles)−15)]° C. to [(glass transition point Tg of the rein)+5)]° C.

In the present invention, preferably, the releasing agent dispersion in which the aforementioned releasing agent is dispersed in an aqueous medium is mixed with the resin particle dispersion (a), and an aggregating agent added to the mixture, to thereby aggregate the particles, for ensuring low-temperature fusing ability and storage stability of the toner. In a preferred mode of preparation of the releasing agent dispersion, a releasing agent is dispersed in an aqueous medium in the presence of a surfactant, and the dispersion is heated to a temperature equal to higher than the melting point of the releasing agent. During heating, the dispersion is subjected to further a dispersing process by means of a homogenizer, an ultrasonic dispersing apparatus, etc. to thereby form microparticles, whereby a dispersion of releasing agent particles having a volume median particle size ($D_{50}$) of preferably 1 μm or less is prepared.

Also in the present invention, in the case where the resin forming the resin particles is a resin having an acidic group such as polyester, a polymer having an oxazoline group is mixed with the resin at 60 to 100° C., to thereby form crosslinked resin particles in which resin particles are crosslinked to the resin, for ensuring the storage stability of the toner. Through aggregating crosslinked resin particles, the softening point of the resin particles increases, to thereby enhance the storage stability of the toner. In addition, in the case where a releasing agent is used in combination, release of the releasing agent from the aggregated particles can be effectively prevented.

The polymer having an oxazoline group which can be employed in the invention may be a polymer having two or more oxazoline groups. The polymer crosslinkingly reacts with a resin forming the resin particles and having an acidic group such as a carboxyl group. The polymer having an oxazoline group may be produced from, for example, a polymerizable monomer having an oxazoline group with an optional polymerizable monomer copolymerizable with the polymerizable monomer having an oxazoline group.

No particular limitation is imposed on the polymerizable monomer having an oxazoline group. Examples thereof include 2-vinyl-2-oxazoline, 2-vinyl-4-methyl-2-oxazoline, 2-vinyl-5-methyl-2-oxazoline, 2-isopropenyl-2-oxazoline, 2-isopropenyl-4-methyl-2-oxazoline, 2-isopropenyl-5-methyl-2-oxazoline, and 2-isopropenyl-5-ethyl-2-oxazoline. These monomers may be used singly or in combination of two or more species. Among them, 2-isopropenyl-2-oxazoline is preferred by virtue of high industrial availability.

The aggregating agent may be used in the form of a solution in an aqueous medium for attaining a uniform aggregation state. As the aqueous medium, the same aggregating agents as employed in the aforementioned production of resin particle dispersion (a) may be used. The aggregating agent may be added singly or intermittently or continuously. During or after addition of the aggregating agent, sufficient stirring is preferably performed.

The solid content of the aggregated particle dispersion produced in step (1) is preferably 5 to 50% by weight, more preferably 5 to 40% by weight, for ensuring productivity and controlling aggregation of the aggregated particle dispersion (A).

As described above, the aggregated particle dispersion (A) is produced through aggregating resin particles in the resin particle dispersion (a).

The aggregated particles contained in the aggregated particle dispersion (A) preferably has a volume median particle size ($D_{50}$) of 1 to 10 μm, more preferably 2 to 9 μm, still more preferably 2 to 5 μm, for minimizing the particle size. The coefficient of variation (CV value) of the particle size distribution is preferably 30% or less, more preferably 28% or less, still more preferably 25% or less.

The coefficient of variation (CV value) of the particle size distribution is derived from the following relationship:

$$\text{CV value}(\%)=[\text{standard deviation of particle size } (\mu m)/\text{volume median particle size } (\mu m)]\times 100.$$

[Step (2)]

In step (2), a resin microparticle dispersion (b) is added to the aggregated particle dispersion (A) produced in step (1), to thereby produce a dispersion (B) of resin microparticle-deposited aggregated particles having an aggregating agent concentration Eb (% by weight) satisfying the following formula 1:

$$0.60 \leq Eb/Ea < 1 \quad \text{(formula 1).}$$

The aggregating agent concentration Eb is calculated by the following formula:

$$Eb(\%\text{ by weight})=[\text{amount of aggregating agent added } (g)/\text{weight of resin microparticle-deposited aggregated particle dispersion}(B)\ (g)]\times 100.$$

Thus, through adding the resin microparticle dispersion (b) to the aggregated particle dispersion (A), to thereby produce the resin microparticle-deposited aggregated particle dispersion (B) containing resin microparticle-deposited aggregated particles, a variety of resin particles can be readily encapsulated.

In the present invention, through adjusting the aggregating agent concentration Eb so as to satisfy formula 1, resin microparticles are uniformly deposited on the surfaces of the aggregated particles. Thus, the produced toner is thought to have an enhanced storage stability and tribocharge stability in the environment.

The aforementioned resin microparticle dispersion (b) may be added singly or several times in a divided manner. Although each addition operation may be further divided, the aggregating agent concentration Eb is preferably maintained within a range where formula 1 is substantially satisfied during deposition of resin microparticles onto the aggregated particles, for controlling the particle size of the aggregated particles. As used herein, the term "substantially" refers to that the concentration is maintained within the range so long as the effects of the present invention can be attained, and temporary deviation is included.

More specifically, in step (2), addition of the resin microparticle dispersion (b) reduces the aggregating agent concentration. In the case of a drop of the aggregating agent concentration below the lower limit defined by formula 1, the concentration is preferably maintained to fall within the aforementioned range through further addition of the aggregating agent. The amount and rate of addition of the aggregating agent may be determined by the aggregating agent concentration of the system at the time of addition; i.e., the rate of addition of the resin microparticle dispersion (b). Specifically, the aggregation agent is preferably added so that the aggregating agent concentration of the system (dispersion containing aggregating agent particles and resin microparticles) is adjusted to Eb represented by formula 1. For ensuring the storage stability of the toner and tribocharge stability in the environment, the aforementioned Eb preferably satisfies the following formula 1', more preferably formula 1":

$$0.65 \leq Eb/Ea \leq 0.95 \quad \text{(formula 1')}$$

and $$0.70 \leq Eb/Ea \leq 0.90 \quad \text{(formula 1")}.$$

In order to uniformly deposit the resin microparticles onto the aggregated particles, step (2) is preferably performed at the same temperature as Ta employed in step (1); i.e., (glass transition point Tg of the resin forming the resin particles+25)° C. or lower, more preferably (Tg−30)° C. to (Tg+25° C.), still more preferably 25° C. to (Tg+25)° C., yet more preferably 25° C. to (Tg+15)° C., further preferably 35° C. to (Tg+5)° C., particularly preferably 40° C. to (Tg−5)° C.

The resin forming the resin microparticles may be the same resin as the resin forming the aforementioned resin particles. Alternatively, a different resin may also be used. In the latter case, the effects of the present invention can be more effectively attained.

In order to control the particle size of the aggregated particles, aggregation property, and productivity, the rate of adding resin microparticle dispersion (b) is preferably adjusted such that the resin forming the resin particles are added at 0.05 to 2.0 parts by weight/minute with respect to 100 parts by weight of the resin contained in the aggregated particles, more preferably 0.05 to 1.5 parts by weight/minute.

The resin microparticle dispersion (b) may be prepared in the same method as employed for preparing the aforementioned resin particle dispersion (a). Also, the resin microparticles contained in the resin microparticle dispersion (b) preferably contain amorphous polyester (b).

In the preparation of the resin microparticle dispersion (b), the resin forming the resin microparticles is dispersed preferably in the presence of a surfactant similar to the method for preparing the resin particle dispersion (a) in step (1). Preferred types and amounts of the surfactant are the same as described in relation to the method for preparing the resin particle dispersion (a).

In addition to the aforementioned resin, the resin microparticle dispersion (b) may further contain additives such as a colorant, a releasing agent, and a charge-controlling agent. The same additives as employed in the preparation of the resin particle dispersion (a) in step (1) may be employed.

The glass transition point of the resin microparticles is appropriately predetermined depending on factors such as the glass transition point of the resin forming the resin microparticles (e.g., amorphous polyester (b)) and the types and amounts of the additives. For ensuring the durability, low-temperature fusing ability, and storage stability of the toner, the glass transition point is preferably 55° C. or higher, more preferably 55 to 75° C., still more preferably 55 to 70° C., further more preferably 55 to 65° C.

For ensuring the storage stability and chargeability of the toner, the amorphous polyester (b) of the resin microparticles is preferably 70% by weight or higher, more preferably 80% by weight or higher, still more preferably 90% by weight or higher, yet more preferably substantially 95% by weight or higher, yet more preferably substantially 100% by weight.

(Amorphous Polyester (b))

In the present invention, amorphous polyester (b) is defined as a polyester which has a crystallinity index, represented by the ratio of softening point to temperature at the maximum endothermic peak measured by means of a differential scanning calorimeter (DSC); i.e., (softening point (° C.))/(maximum endothermic peak temperature (° C.)), of higher than 1.4 or lower than 0.6.

For ensuring the low-temperature fusing ability of the toner, the crystallinity index of amorphous polyester (b) is preferably lower than 0.6, or higher than 1.4 and 4 or lower, more preferably lower than 0.6, or 1.5 to 4, still more preferably lower than 0.6, or 1.5 to 3, yet more preferably lower than 0.6, or 1.5 to 2. The crystallinity index may be predetermined depending on factors such as the types and proportions of monomers and production conditions (e.g., reaction temperature, reaction time, and cooling rate).

The amorphous polyester (b) preferably has an acid group at a molecular end. Examples of the acid group include a carboxyl group, a sulfonic acid group, a phosphonic acid group, and a sulfinic acid group. Of these, a carboxylic group is preferred, since emulsification of the polyester is promoted.

The amorphous polyester (b) may be produced through the same method as employed in the production of the aforementioned polyester; i.e., through polycondensation between an acid component and an alcohol component.

Examples of the acid component include dicarboxylic acid, succinic acid substituted by a C1 to C20 alkyl group or a C2 to C20 alkenyl group, and a polyvalent (trivalent or higher-valent) carboxylic acid. The carboxylic acid encompasses a corresponding acid anhydride and alkyl (C1 to C3) esters. Among them, dicarboxylic acid is preferred.

Examples of the dicarboxylic acid include phthalic aid, isophthalic acid, terephthalic acid, sebacic acid, fumaric acid, maleic acid, adipic acid, azelaic acid, succinic acid, and cyclohexanedicarboxylic acid. Of these, terephthalic acid is preferred.

Examples of the succinic acid substituted by a C1 to C20 alkyl group or a C2 to C20 alkenyl group include dodecylsuccinic acid, dedecenylsuccinic acid, and octenylsuccinic acid.

Examples of the polyvalent (trivalent or higher-valent) carboxylic acid include trimellitic acid, 2,5,7-naphthalenetricarboxylic acid, and pyromellitic acid. Of these, trimellitic acid is preferred, form the viewpoint of offset resistance.

These acid components may be used singly or in combination of two or more species.

For ensuring offset resistance, the polyester (b) preferably includes at least one amorphous polyester (b) produced from an acid component containing polyvalent (trivalent or higher-valent) carboxylic acid, preferably trimellitic acid.

The same alcohol components as employed in the aforementioned polyester may be used. Among them, aromatic diols are preferred, with alkylene (C2 or C3) oxide adducts (average molar number of addition: 1 to 16) of bisphenol A such as polyoxypropylene-2,2-bis(4-hydroxyphenyl)propane and polyoxyethylene-2,2-bis(4-hydroxyphenyl)propane being more preferred, for producing amorphous polyester.

These alcohol components may be used singly or in combination of two or more species.

For ensuring the durability, low-temperature fusing ability, and storage stability of the toner, the glass transition point of the amorphous polyester (b) is preferably 55 to 75° C., more preferably 55 to 70° C., still more preferably 58 to 68° C.

From the same viewpoints, the softening point of the amorphous polyester (b) is preferably 70 to 165° C., more preferably 70 to 140° C., still more preferably 90 to 140° C., yet more preferably 100 to 130° C.

In the case where two or more species of amorphous polyester (b) are employed, the glass transition point and softening point refer to a glass transition point and a softening point of the mixture of two or more species of amorphous polyester (b) determined through the method described in the Examples hereinbelow.

For ensuring the durability, low-temperature fusing ability, and storage stability of the toner, the number average molecular weight of the amorphous polyester (b) is preferably 1,000 to 50,000, more preferably 1,000 to 10,000, still more preferably 2,000 to 8,000.

From the viewpoint of the emulsification property of the resin in an aqueous medium, the acid value of the amorphous polyester (b) is preferably 6 to 35 mg-KOH/g, more preferably 10 to 35 mg-KOH/g, still more preferably 15 to 35 mg-KOH/g.

For ensuring the low-temperature fusing ability, offset resistance, and durability of the toner, the amorphous polyester (b) preferably include two polyesters having different softening points. Regarding the two polyesters having different softening points; i.e., polyesters (b-1) and (b-2), polyester (b-1) preferably has a softening point of 70° C. or higher and lower than 115° C., and polyester (b-2) preferably has a softening point of 115° C. to 165° C. The ratio by weight of polyester (b-1) to polyester (b-2); i.e., ((b-1)/(b-2)) is preferably 10/90 to 90/10, more preferably 50/50 to 90/10.

The solid content of the resin microparticle dispersion (b) is preferably 7 to 50% by weight, more preferably 7 to 40% by weight, still more preferably 10 to 35% by weight, for stabilizing the dispersion and attaining uniform deposition to the aggregated particles.

The thus-produced resin microparticles preferably have a volume median particle size ($D_{50}$) of 0.02 to 2 μm, more preferably 0.05 to 1 μm, still more preferably 0.05 to 0.6 μm, for attaining uniform aggregation.

For ensuring the storage stability and chargeability of the toner, the relative amount of resin microparticles contained in the resin microparticle dispersion (b) added to the aggregated particles is preferably such that 5 to 100 parts by weight (more preferably 10 to 90 parts by weight, still more preferably 20 to 80 parts by weight) of the resin forming the resin microparticles is added to 100 parts by weight of the resin forming the aggregated particles.

In step (2), in the case where the resin microparticle dispersion (b) is added several times in a divided manner, the divided portions of the dispersion preferably have the same resin microparticle amount. In the case where the aggregating agent is added in a divided manner, the divided portions preferably have the same aggregating agent amount. When the resin microparticle dispersion (b) is added several times in a divided manner, no particular limitation is imposed on the time of divided addition. However, from the viewpoints of the particle size distribution, productivity, etc. of the formed resin microparticle-deposited aggregated particles, the time of divided addition is preferably 2 to 10, more preferably 2 to 8.

From the viewpoints of the aggregation property, the particle size distribution of the formed resin microparticle-deposited aggregated particles and other factors, in the addition of the resin microparticle dispersion (b) several times, an aging process is preferably performed for 5 to 15 minutes after one addition operation, more preferably for 5 to 30 minutes, particularly preferably 5 minutes to 2 hours. More preferably, an aging process for such a period of time is performed after each addition operation. The aging time is defined by the period of time from the completion of addition of dispersion (b) to the start of the subsequent addition of the aggregating agent and/or the resin microparticle dispersion (b).

In step (2), for obtaining high-quality toner images, the volume median particle size ($D_{50}$) of the resin microparticle-deposited aggregated particles is preferably 1 to 10 μm, more preferably 2 to 10 μm, still more preferably 3 to 10 μm.

[Step (3)]

In step (3), the aggregating agent concentration of the dispersion (B) of resin microparticle-deposited aggregated particles produced in step (2) is modified, to thereby produce a dispersion (C) of resin microparticle-deposited aggregated particles, having an aggregating agent concentration Ec (% by weight) satisfying the following formula 2:

$$0<Ec/Ea\leq 0.30 \quad \text{(formula 2).}$$

Similar to Eb, the aggregating agent concentration Ec is calculated by the following formula:

$$Ec(\%\text{ by weight})=[\text{amount of aggregating agent added (g)/weight of resin microparticle-deposited aggregated particle dispersion}(C)\text{ (g)}]\times 100.$$

In the present invention, through adjusting the aggregating agent concentration Ec so as to satisfy the formula 2, at least the storage stability of the produced toner can be improved.

The aggregating agent concentration Ec preferably satisfies the following formula 2-A:

$$0.005\leq Ec/Ea\leq 0.30 \quad \text{(formula 2-A).}$$

In the first embodiment of the present invention, since the aggregating agent concentration Ec (% by weight) satisfies the following formula 2-1, a toner for electrophotography having an improved storage stability of toner, tribocharge stability in the environment, and low incidence of toner cloud of the toner can be produced. In the second embodiment of the present invention, since the aggregating agent concentration Ec (% by weight) satisfies the following formula 2-2, a toner for electrophotography having both an improved storage stability of the toner and an improved image-transferability can be produced.

$$0.08<Ec/Ea\leq 0.30 \quad \text{(formula 2-1)}$$

$$0.005\leq Ec/Ea\leq 0.08 \quad \text{(formula 2-2)}$$

That is, in step (3) of the first embodiment of the present invention, in order to improve storage stability of the toner, tribocharge stability in the environment, and low incidence of toner cloud of the toner, the aggregating agent concentration Ec (% by weight) is modified after preparation of the resin microparticle-deposited aggregated particles in step (2) so as to preferably satisfy the following formula 2-1, more preferably the following formula 2-1', still more preferably the following formula 2-1".

$$0.08<Ec/Ea\leq 0.30 \quad \text{(formula 2-1)}$$

$$0.09\leq Ec/Ea\leq 0.28 \quad \text{(formula 2-1')}$$

$$0.09\leq Ec/Ea\leq 0.25 \quad \text{(formula 2-1")}$$

When the aggregating agent concentration ratio (Ec/Ea) is higher than 0.08, an improved chargeability can be attained, good storage stability, tribocharge stability in the environment, and low incidence of toner cloud can be realized. Although the reason for this has not been precisely elucidated, coalescing of resin microparticles occurs faster than that of aggregated particles when the aggregating agent concentration ratio falls within the above range. Thus, conceivably, coalescing of the resin microparticles occurs between resin particles before coalescing of aggregated particles; i.e., before disappearance of interfaces, thereby providing smooth surfaces of the toner particles having irregularity. This particular shape of the toner particles is thought to give a certain effect on chargeability. When the aggregating agent concentration ratio (Ec/Ea) is 0.30 or lower, coalescing of resin microparticle-deposited particles readily proceeds, to ensure sufficient coalescence, whereby the storage stability is improved.

In step (3) of the second embodiment of the present invention, for attaining good storage stability and image-transferability of the toner, the aggregating agent concentration Ec is modified after preparation of the resin microparticle-deposited aggregated particles in step (2) so as to preferably satisfy the following formula 2-2, more preferably the following formula 2-2', still more preferably the following formula 2-2".

$$0.005\leq Ec/Ea\leq 0.08 \quad \text{(formula 2-2)}$$

$$0.005\leq Ec/Ea\leq 0.06 \quad \text{(formula 2-2')}$$

$$0.005\leq Ec/Ea\leq 0.04 \quad \text{(formula 2-2")}$$

When the aggregating agent concentration ratio (Ec/Ea) is 0.05 or higher, the resin microparticle-deposited aggregated particles are stable in the dispersion, and release of resin microparticles and a similar phenomenon do not occur, thereby forming particles having a uniform shape. Thus, the produced toner has good image transferability and storage stability. When the aggregating agent concentration ratio (Ec/Ea) is 0.08 or lower, the toner particles have virtually spherical, and the image-transferability is likely to be enhanced.

In step (3), preferably, the aggregating agent concentration Ec is adjusted by adding an aqueous medium to the resin microparticle-deposited aggregated particle dispersion (B) produced in step (2). The aqueous medium may be added dropwise singly or in a divided manner, or singly or continuously. The same aqueous medium as employed in production of the resin particles may also be used.

For controlling the particle size of the resin microparticle-deposited aggregated particles and ensuring the productivity thereof, the particle size of the resin microparticle-deposited aggregated particles is regulated to a size of interest, and then regulated so as to adjust the aggregating agent concentration Ec to fall within the above ranges, preferably within one hour, more preferably within 30 minutes, still more preferably within 10 minutes. The resin microparticle-deposited aggregated particles may be prepared while the particle size of the resin microparticle-deposited aggregated particles is monitored.

No particular limitation is imposed on the temperature employed in step (3). But, from the viewpoint of the stability of the resin microparticle-deposited aggregated particles in the dispersion, the temperature employed in production of the resin microparticle-deposited aggregated particle dispersion (B) in step (2) is preferably employed.

In the third embodiment of the present invention, step (3) includes the following steps (3-1) and (3-2).

[Step (3-1)]

In step (3-1), the dispersion (B) of resin microparticle-deposited aggregated particles produced in step (2) is maintained at a temperature which is equal to or higher than a temperature lower by 10° C. than the glass transition point of an amorphous polyester (b) contained in the resin microparticles in the resin microparticle dispersion (b), to thereby produce a core/shell particle dispersion (1) having an aggregating agent concentration of 0.05 to 0.40 mol/L and a particle circularity of 0.920 to 0.970.

In this step, the resin particles containing core aggregated particles and an amorphous polyester added thereto for forming shell portions are partially coalesced, to thereby form core/shell particles having a particle circularity of 0.920 to 0.970.

In step (3-1), for ensuring the storage stability of the toner and suppression of toner cloud in a printing machine such as a printer, the dispersion (B) of resin microparticle-deposited aggregated particles produced in step (2) is maintained at a temperature which is equal to or higher than a temperature lower by 10° C. than the glass transition point of an amorphous polyester (b) contained in the resin microparticles in the resin microparticle dispersion (b). Notably, in step (2), when the temperature range has been adjusted during addition of the resin microparticle dispersion (b) to the aggregated particle dispersion (A) produced in step (1), maintenance of the temperature within the above range is not required after addition of the resin microparticle dispersion (b). However, in the case where the size and shape of the particles are needed, preferably, the resin microparticle dispersion (b) is added at a temperature lower than the temperature lower by 10° C. than the glass transition point of amorphous polyester (b), and after completion of addition, the mixture is maintained at a temperature equal to or higher than the temperature lower by 10° C. than the glass transition point.

Through controlling the retention temperature to a temperature equal to or higher than the temperature lower by 10° C. than the glass transition point of amorphous polyester (b), preferably to a temperature equal to or higher than the temperature lower by 5° C. than the glass transition point, more preferably to a temperature equal to or higher than the temperature higher by 2° C. than the glass transition point, the coalescing property, storage stability, chargeability, and productivity of the toner can be enhanced.

Through satisfying the these conditions, the crystalline state of the releasing agent exhibiting high fusing ability at low temperature is maintained; development of the releasing agent to the toner surface which would otherwise cause a drop in storage stability and chargeability of the toner can be prevented; and shell portions can be uniformly coalesced, whereby a toner excellent in low-temperature fusing ability, chargeability, and storage stability can be conceivably produced.

For ensuring the coalescing property, storage stability, chargeability, and productivity of the toner, in this step, the dispersion (B) is preferably maintained at a temperature equal to or higher than the temperature lower by 5° C. than the glass transition point of the resin microparticles, more preferably at a temperature equal to or higher than the temperature lower by 2° C. than the glass transition point of the resin microparticles.

In view of the foregoing, the retention temperature in step (3-1) is preferably 58 to 69° C., more preferably 59 to 67° C., still more preferably 60 to 64° C.

The retention time in this step is preferably 1 to 24 hours, more preferably 1 to 12 hours, still more preferably 2 to 6 hours, for attaining the coalescing property of the particles and the storage stability, chargeability, and productivity of the toner.

The aggregating agent concentration of the core/shell particle dispersion (1) produced in step (3-1) is 0.05 to 0.40 mol/L, preferably 0.10 to 0.30 mol/L, from the viewpoint of enhancing the storage stability of the toner and suppressing toner cloud.

In the present invention, an aggregating agent concentration of dispersion (mol/L) means an amount of an aggregating agent in 1 L of liquid that insoluble components such as resin particles in solvent is removed.

In this step, the progress of coalescing is preferably confirmed by monitoring the circularity of the formed core/shell particles. Monitoring of circularity is performed through the method described in the Examples hereinbelow. When the circularity reaches 0.920 or higher, cooling is started to terminate coalescing. The circularity of the core/shell particles contained in the finally formed core/shell particle dispersion (1) is 0.920 to 0.970, preferably 0.930 to 0.960, more preferably 0.940 to 0.950, for suppressing toner cloud.

The BET specific surface area of the core/shell particles contained in the core/shell particle dispersion (1) as determined through the nitrogen adsorption method is preferably 4.0 $m^2/g$ or more and less than 14.0 $m^2/g$, more preferably 4.5 to 12.0 $m^2/g$, still more preferably 5.0 to 10.0 $m^2/g$, yet more preferably 5.5 to 8.0 $m^2/g$, for enhancing the storage stability of the toner.

The volume median particle size of the core/shell particles contained in the core/shell particle dispersion (1) is preferably 1 to 10 μm, more preferably 2 to 10 μm, still more preferably 3 to 9 μm, yet more preferably 4 to 6 μm, for obtaining high-quality toner images.

[Step (3-2)]

In step (3-2), at least a part of the aggregating agent is removed from the core/shell particle dispersion (1) produced in step (3-1), to thereby produce a dispersion (C) of resin microparticle-deposited aggregated particles having an aggregating agent concentration Ec. Preferably, at least a part of the aggregating agent and the aqueous medium is removed from the core/shell particle dispersion (1), to thereby produce a slurry, and an aqueous medium is added to the slurry (step (3a)).

In step (3a), which is a preferred mode of step (3-2), at least a part of the aggregating agent and the aqueous medium is removed, to thereby prepare a slurry having a high solid content (hereinafter may be referred to simply as "slurry"). In step (3a), the entirety of the aggregating agent and the aqueous medium may be removed. However, for controlling the particle size distribution upon the re-dispersing process and preventing secondary aggregation of the particles, at least a part of them is preferably left, and the slurry is produced.

Removal of at least a part of the aggregating agent and the aqueous medium may be performed through a method generally employed in solid-liquid separation such as suction filtration, centrifugal dehydration, or pressurized filtration. From the viewpoint of operability in, for example, adjusting solid content, suction filtration or a similar method is preferred.

No particular limitation is imposed on the filtration apparatus employed in suction filtration, so long as the apparatus is generally employed in filtration. In order to maintain the aggregation state of the particles and adjust the solid content of the slurry to a specific value, a filtration apparatus consisting of a suction pot equipped with a Buchner funnel is preferably employed.

For controlling the particle size distribution upon the re-dispersing process and preventing secondary aggregation of the particles, the solid content of the slurry is preferably 10 to 60% by weight, more preferably 20 to 50% by weight, still more preferably 30 to 40% by weight.

Subsequently, an aqueous medium is added to the thus-produced slurry.

Examples of the aqueous medium added to the slurry include the same as described above. Virtually, water is preferred, with deionized water being more preferred.

In the addition of the aqueous medium, a surfactant may be further added. Examples of the surfactant include the same as described above. Among them, anionic surfactants are preferred, with alkyl ether sodium sulfate being more preferred.

In order to re-disperse particles in the slurry after addition of the aqueous medium thereto, stirring is preferably performed. Examples of the stirring method include a method in which the liquid is stirred by rotating stirring paddles of a stirrer, and a method employing a disperser such as a homomixer. For maintaining the aggregation state of particles, a method employing a stirrer is preferred.

In step (3-2), after completion of addition of the aqueous medium in step (3a), step (3a) is repeated further one or more times (step (3b)). Specifically, at least a part of the aggregating agent and the aqueous medium is removed from the core/shell particle dispersion produced in step (3a) from which at least a part of the aggregating agent has been removed, to thereby form a slurry, and an operation of adding the aqueous medium to the thus-formed slurry is performed one or more times. Through performing step (3b), the aggregating agent concentration can be effectively reduced, and coalescing of particles can be promoted in the subsequent step (4).

For enhancing the storage stability of the toner and preventing toner cloud, the aggregating agent concentration of the core/shell particle dispersion (C) produced in step (3-2) is lower than 0.05 mol/L, preferably lower than 0.005 mol/L.

Further more, for enhancing the storage stability of the toner and preventing toner cloud, the aggregating agent concentration of the core/shell particle dispersion (2) is preferably adjusted to 0.2 times or less of the aggregating agent concentration of the core/shell particle dispersion (1), more preferably 0.07 times or less, still more preferably 0.03 times or less.

In the present invention, for preventing further aggregation, a step of adding an aggregation-terminating agent is preferably provided before coalescence. The aggregation-terminating agent is preferably a surfactant, with an anionic surfactant being more preferably used. Among anionic surfactants, at least one species selected from the group consisting of alkyl ether sulfate salts, alkyl sulfate salts, and linear chain alkylbenzenesulfonate salts is added, which is further preferred.

In the present invention, for attaining uniform coalescing of aggregated particles and enhancing the storage stability and chargeability of the toner, it is preferable to use an aggregation-terminating agent represented by the following formula (3):

$$R—O—(CH_2CH_2O)_nSO_3M \quad (3)$$

wherein R represents an alkyl group, M represents a monovalent cation, and n represents an average molar number of addition of 0 to 15.

The alkyl group as R in the formula (3) is an alkyl group preferably having 4 to 16 carbon atoms, more preferably 6 to 14 carbon atoms and further preferably 8 to 12 carbon atoms for ensuring adsorption of the compound to the aggregated particles and the reduction in amount of the compound remaining in the toner. Specific examples of the alkyl group include butyl, pentyl, hexyl, heptyl, octyl, nonyl, decyl, dodecyl, tetradecyl, and pentadecyl. The average molar number of addition (n) is 0 to 15. In order to control the particle size, the number is preferably 0 to 5, more preferably 0 to 3. M is a monovalent cation. In order to control the particle size, the cation is preferably a monovalent metal cation or an ammonium ion, with sodium ion, potassium ion, lithium ion, and ammonium ion being preferred and sodium ion and ammonium ion being still more preferred.

Specific examples of the aggregation-terminating agent employed in the present invention include $C_{12}H_{25}(OCH_2CH_2)_2OSO_3Na$ and $C_{12}H_{25}(OCH_2CH_2)_3OSO_3Na$.

The aforementioned aggregation-terminating agents may be used singly or in combination of two or more species.

The amount of the aforementioned aggregation-terminating agent added is preferably 0.1 to 15 parts by weight, more preferably 0.1 to 10 parts by weight, still more preferably 0.1 to 8 parts by weight, with respect to 100 parts by weight of the resin forming the resin microparticle-deposited aggregated particles (i.e., the sum of the resin forming the aggregated particles and the resin forming the resin microparticles), for completing termination of aggregation and reducing the amount of the aggregation-terminated compound remaining in the toner. So long as the amount falls within the above ranges, ant form of the agent may be added. From the viewpoint of productivity, an aqueous solution is preferably added.

In the present invention, when the aggregating agent concentration of the resin microparticle-deposited aggregated particle dispersion is adjusted to Ec through addition of aqueous solution of the aforementioned aggregation-terminating agent, coalescence can be performed at low temperature, and a good chargeability of the produced toner is attained, which is preferred. In this case, the aggregating agent concentration ratio (Ec/Ea) is preferably modified through modification of the aqueous solution of the aggregation-terminating agent (i.e., the amount of water diluting the aggregation-terminating agent).

The aggregation-terminating agent may be added singly, or intermittently or continuously.

[Step (4)]

In step (4), the resin microparticle-deposited aggregated particles in the dispersion (C) of resin microparticle-deposited aggregated particles having an aggregating agent concentration Ec and produced in step (3) is heated at a temperature falling within a range between the glass transition point Tg (° C.) of the resin microparticles in the resin microparticle dispersion (b) and (Tg+20) (° C.), to thereby coalesce the aggregated particles (hereinafter step (4) may be referred to as "coalescence step").

In step (4), the resin microparticle-deposited aggregated particles are heated so as to coalesce the aggregated particle portions of the resin microparticle-deposited aggregated particles, and to coalesce the resin microparticles with the aggregated particles, whereby coalesced particles are formed. A conceivable mechanism is as allows. In the resin microparticle-deposited aggregated particles, the resin particles in the aggregated particles; the resin microparticles in the resin microparticle-deposited aggregated particles; and the aggregated particles and the resin microparticles in the resin microparticle-deposited aggregated particles are physically assembled together. However, through performing the coalescence step, the aggregated particles (also called core particles) are assembled and coalesced, and the resin microparticles, core particles, and resin microparticles are coalesced together, to thereby form coalesced particles.

From the viewpoints of the particle size, particle size distribution, and shape control of the target toner; coalescing property of the resin particle-deposited aggregated particles; and storage stability of the toner, tribocharge stability in the environment, and low incidence of toner cloud, the heating temperature in step (4) is preferably a temperature which is equal to or higher than the glass transition point Tg of the resin microparticles in the resin microparticle dispersion (b) and which is lower than (Tg of the resin microparticles+15)° C., more preferably a temperature which is (Tg of the resin microparticles)° C. or more and (Tg of the resin microparticles+10)° C. or less, still more preferably a temperature which is (Tg of the resin microparticles)° C. or more and (Tg of the resin microparticles+5)° C. or less.

Also, form the viewpoints of the particle size, particle size distribution, and shape control of the toner; coalescing property of the resin particle-deposited aggregated particles; and storage stability and image-transferability of the toner, the heating temperature is preferably a temperature which is (Tg of the resin microparticles)° C. or more and (Tg of resin microparticles+10)° C. or less, more preferably a temperature which is (Tg of the resin microparticles)° C. or more and (Tg of the resin microparticles+5)° C. or less.

In the present invention, when a releasing agent is employed, for ensuring the low incidence of toner cloud of the toner and tribocharge stability in the environment, the aforementioned heating temperature is preferably a temperature which is equal to or higher than the glass transition point Tg (° C.) of the resin microparticles in the resin microparticle dispersion (b) and which is lower than (the melting point of the releasing agent particles−5)° C., more preferably a temperature which is equal to or higher than the Tg (° C.) of the resin microparticles and which is lower than (the melting point of the releasing agent particles−7)° C., still more preferably a temperature which is equal to or higher than (Tg of the resin microparticles+5)° C. and which is lower than (the melting point of the releasing agent particles−10)° C.

No particular limitation is imposed on the retention time at the heating temperature employed in step (4), so long as coalescence of the aggregated particles and the resin microparticles is sufficiently carried out. However, from the viewpoint of the chargeability of the toner, the retention time is preferably 0.5 to 20 hours, more preferably 1 to 10 hours.

Meanwhile, in step (4) of the third embodiment of the present invention, for ensuring the storage stability of the toner and suppression of toner cloud in a printing machine such as a printer, the resin microparticle-deposited aggregated particle dispersion (C) having an aggregating agent concentration Ec is preferably maintained at a temperature which is lower than the melting point of the releasing agent and which is equal to or higher than (the glass transition point of amorphous polyester (b)−10° C.), to thereby form a core/shell particle dispersion (3) having a particle circularity of 0.950 to 0.980. Note that, the circularity of the particles contained in the core/shell particle dispersion (3) is preferably greater by ≥0.005 than the circularity of the particles contained in the core/shell particle dispersion (1).

Through controlling the retention temperature of the resin microparticle-deposited aggregated particle dispersion (C) having an aggregating agent concentration Ec such that the temperature is lower than the melting point of the releasing agent, preferably lower than (the melting point of the releasing agent−5° C.), more preferably lower than (the melting point of the releasing agent−10° C.), the chargeability of the toner can be enhanced.

Also, through controlling the retention temperature of the resin microparticle-deposited aggregated particle dispersion (C) having an aggregating agent concentration Ec such that the temperature is equal to or higher than (the glass transition point of amorphous polyester (b)−10° C.), preferably equal to or higher than (the glass transition point of amorphous polyester (b)−5° C.), more preferably equal to or higher than (the glass transition point of amorphous polyester (b)−2° C.), the coalescing property, storage stability of the toner, chargeability, and productivity of the toner can be enhanced.

Through satisfying the these conditions, the crystalline state of the releasing agent exhibiting high fusing ability at low temperature is maintained; development of the releasing agent to the toner surface which would otherwise cause a drop in storage stability and chargeability of the toner can be prevented; and shell portions can be uniformly coalesced, whereby a toner excellent in low-temperature fusing ability, chargeability, and storage stability can be conceivably produced.

Furthermore, for ensuring the coalescing property, storage stability of the toner, chargeability, and productivity of the toner, in step (4) of the third embodiment of the present invention, the dispersion (C) is preferably maintained at a temperature equal to or higher than (the glass transition point of the resin microparticles −5° C.), more preferably equal to or higher than (the glass transition point of the resin microparticles+2° C.).

In consideration of the above, the retention temperature in step (4) is preferably 58 to 69° C., more preferably 59 to 67° C., still more preferably 60 to 64° C.

The period of time when the dispersion is maintained at the retention temperature in step (4) is preferably 0.1 to 24 hours, more preferably 0.5 to 12 hours, still more preferably 1 to 6 hours, for ensuring the coalescing property of the particles, storage stability, chargeability, and productivity of the toner.

In step (4) of the third embodiment of the present invention, the circularity of the formed core/shell particles is preferably monitored so as to confirm the degree of coalescing. Monitoring of the circularity is performed through the method described in the Examples. When the circularity has reached 0.950 or higher and is higher by ≥0:005 than the circularity of the particles contained in the core/shell particle dispersion (1); i.e., has reached a target value, the particles are cooled, to thereby terminate coalescing. The circularity of the core/shell particles contained in the finally produced core/shell particle dispersion (3) is 0.950 to 0.980, preferably 0.950 to 0.970, more preferably 0.955 to 0.965, for enhancing the storage stability of the toner and suppressing toner cloud.

[Post-Treatment Step]

The thus-produced coalesced particles are subjected to a solid-liquid separation step (e.g., filtration), a washing step, and a drying step, whereby toner particles are yielded. In this case, in order to ensure sufficient charging characteristics and reliability of the toner, metal ions remaining on the surfaces of the toner particles are preferably washed out with acid in the washing step. Also, the nonionic surfactant added thereto is preferably removed. Thus, the coalesced particles are preferably washed with aqueous solution at a temperature equal to or lower than the cloud point of the nonionic surfactant. Preferably, washing is repeatedly performed.

In the drying step, there may be employed any technique such as the vibration-type fluidizing drying method, spray drying, freeze-drying, or the flush jet method. The water content of the dried toner particles is preferably adjusted to 1.5% by weight or less, more preferably 1.0% by weight or less, from the viewpoint of the chargeability of the toner.

In order to obtain high-quality images, the volume median particle size ($D_{50}$) of the coalesced particles is preferably 1 to 10 μm, more preferably 2 to 8 μm, still more preferably 3 to 8 μm, yet more preferably 4 to 6 μM.

<Toner for Electrophotography>

The toner for electrophotography is produced through the production process of the present invention including steps (1) to (4) and exhibits an improved storage stability, tribocharge stability in the environment, and low incidence of toner cloud. Both the storage stability and the image-transferability are satisfactory. The details of steps (1) to (4) are described above.

The softening point of the toner is preferably 60 to 140° C., more preferably 60 to 130° C., still more preferably 60 to 120° C., from the viewpoint of the low-temperature fusing ability of the toner. The glass transition point is preferably 30 to 80° C., more preferably 40 to 70° C., from the viewpoints of the low-temperature fusing ability, durability, and storage stability of the toner. The methods of measuring the softening point and the glass transition point are the same as employed in the measurement of these temperatures of the resins.

The toner particles preferably have a BET specific surface area, as measured through the nitrogen adsorption method, of 1.5 to 6.0 $m^2/g$, for ensuring suppression of toner cloud and storage stability. The BET specific surface area is more preferably 1.5 to 4.0 $m^2/g$, still more preferably 1.5 to 3.0 $m^2/g$, from the viewpoint of storage stability.

Also in the third embodiment of the present invention, the core/shell particles contained in the core/shell particle dispersion (3) preferably have a BET specific surface area, as measured through the nitrogen adsorption method, of 1.0 $m^2/g$ or more and less than 4.0 $m^2/g$, more preferably 1.0 to 3.0 $m^2/g$, still more preferably 1.0 to 2.5 $m^2/g$, yet more preferably 1.0 to 2.0 $m^2/g$, from the enhancement of the storage stability of the toner and suppression of toner cloud.

In the first embodiment of the present invention, the circularity of the toner particles is preferably 0.930 or higher and lower than 0.980, more preferably 0.940 to 0.975, still more preferably 0.950 to 0.970 (hereinafter a toner having a particle circularity of 0.930 or higher and lower than 0.980 may be referred to as a pseudo-spherical particle toner), for ensuring the storage stability of the toner, tribocharge stability in the environment, and suppression of toner cloud. In the second embodiment of the present invention, the circularity of the toner particles is preferably 0.980 or higher, more preferably 0.982 or higher, still more preferably 0.985 or higher (hereinafter a toner having a particle circularity of 0.980 or higher may be referred to as a spherical particle toner), for ensuring the storage stability and image-transferability of the toner. In the third embodiment of the present invention, the circularity of the toner particles is preferably 0.950 to 0.980, more preferably 0.955 to 0.970, still more preferably 0.955 to 0.965, for ensuring the storage stability, chargeability, and cleaning performance of the toner.

The aforementioned pseudo-spherical particle toner may be produced through adjusting the aggregating agent concentration Ec in step (3) so as to satisfy the relationship: $0.08<Ec/Ea\leq0.30$. The aforementioned spherical particle toner may be produced through adjusting the aggregating agent concentration ratio (Ec/Ea) in step (3) so as to satisfy the relationship: $0.005\leq Ec/Ea\leq0.08$. In the present invention, the circularity of toner particles is derived from the ratio of (peripheral length of a circle having the same area as the projected area of a toner particle)/(peripheral length of the projection of the toner particle). When the particle is perfectly spherical, the circularity is 1.

The BET specific surface area and the circularity of the toner particles may be determined through the methods as described hereinbelow.

When a releasing agent, a colorant, a charge-controlling agent, or the like is employed, with respect to 100 parts by weight of binder resin in the toner, the releasing agent content is preferably 0.5 to 20 parts by weight, more preferably 1 to 18 parts by weight, still more preferably 1.5 to 15 parts by weight, from the viewpoint of the fusing ability of the toner; the colorant content is preferably 20 parts by weight or less, more preferably 0.01 to 10 parts by weight or less; and the charge-controlling agent content is preferably 10 parts by weight, more preferably 0.01 to 5 parts by weight.

In the present invention, the toner particles produced through the aforementioned production process may be used as a toner without any further treatment. Alternatively, the thus-produced toner particles may be surface-treated with an external additive (aid) such as a fluidizing agent etc., to thereby provide a toner. Any microparticles may be used as an external additive in the invention, and examples include inorganic microparticles such as surface-hydrophobicized silica microparticles, titanium oxide microparticles, alumina microparticles, cerium oxide microparticles, and carbon black microparticles; and microparticles of polymer such as polycarbonate, poly(methyl methacrylate), and silicone resin. Among them, surface-hydrophobicized silica microparticles are preferred.

In the case where the surface of the toner particles are treated with an external additive, the amount of external additive is preferably 1 to 5 parts by weight, more preferably 1.5 to 3.5 parts by weight, with respect to 100 parts by weight toner particles which has not undergone the treatment with the external additive.

In order to obtain high-quality toner images and ensuring the productivity of the toner, the volume median particle size ($D_{50}$) of the toner particles is preferably 1 to 10 μm, more preferably 2 to 8 μm, still more preferably 3 to 7 μm, yet more preferably 4 to 6 μm.

The aforementioned coalesced particles and toner particles preferably have a CV value of 30% or less, more preferably 27% or less, still more preferably 25% or less, yet more preferably 22% or less, for obtaining high-quality toner images and ensuring the productivity of the toner. The particle size and particle size distribution may be determined through the method described hereinbelow.

The toner for electrophotography produced through the production process of the present invention may be used as a single-component developer or a two-component developer with a carrier.

EXAMPLES

In the following Production Examples, Examples, and Comparative Examples, various properties were measured and evaluated by the following methods.

[Acid Value of Resins]

The acid value of resins was determined according to JIS K0070. However, a mixed solvent containing acetone and toluene at a volume ratio of 1:1 (Method A) or chloroform (Method B) was used as a solvent for measurement.

[Softening Point and Glass Transition Point of Resins and Toners]

(1) Softening Point

A flow tester "CFT-500D" available from Shimadzu Corporation was employed. A sample (1 g) was extruded through a nozzle having a die pore diameter of 1 mm and a length of 1 mm, while the sample was heated at a temperature rise rate of 6° C./min, and a load of 1.96 MPa was applied thereto by means of a plunger. The downward movement amounts of the plunger of the flow tester were plotted with respect to temperature. The softening point was determined as the temperature at which a half the amount of the sample was flowed out.

(2) Maximum Endothermic Peak Temperature, Melting Point, and Glass Transition Point The glass transition point was measured through the following Method C or D.

(Method C)

By means of a differential scanning calorimeter (commercially available from PerkinElmer Co., Ltd., Pyris 6 DSC), a sample was heated to 200° C. and then cooled from 200° C. to −10° C. at a temperature drop rate of 10° C./min, and thereafter heated again at temperature rise rate of 10° C./min to measure a glass transition point thereof. When a peak was observed at a temperature lower by 20° C. or more than the softening point, the peak temperature was read as the glass transition point. Whereas, when a shoulder of the characteristic curve was observed without any peaks at the temperature lower by 20° C. or more than the softening point, the temperature at which a tangential line having a maximum inclination of the curve in the portion of the shoulder was intersected with an extension of the baseline on the high-temperature side of the curve shift was read as the glass transition point. Meanwhile, since the glass transition point is a physical property attributable to an amorphous portion of resin, amorphous polyester exhibits a glass transition point. However, when a crystalline polyester contains an amorphous portion, a glass transition point may also be observed in some cases.

(Method D)

By means of a differential scanning calorimeter (commercially available from PerkinElmer Co., Ltd., Pyris 6 DSC), a sample was heated to 200° C. and then cooled from 200° C. to 0° C. at a temperature drop rate of 50° C./min, and thereafter heated again at temperature rise rate of 10° C./min to measure a glass transition point thereof. Among the observed endothermic peaks, the temperature at which the peak having the largest peak area was observed was read as the glass transition point. In the case where the sample was a crystalline polyester, the peak temperature was read as the melting point. In the case of amorphous polyester, when a endothermic peak was observed, the peak temperature was read as the glass transition point. Whereas, when a shoulder of the characteristic curve was observed instead of a peak, the temperature at which a tangential line having a maximum inclination of the curve in the portion of the shoulder was intersected with an extension of the baseline on the high-temperature side of the curve shift was read as the glass transition point.

[Number-Average Molecular Weight of Resins]

The number-average molecular weight was calculated from the molecular weight distribution measured through gel permeation chromatography according to the following method.

(1) Preparation of Sample Solution

A resin was dissolved in chloroform to thereby prepare a solution having a concentration of 0.5 g/100 mL. The solution was then filtered through a fluororesin filter ("FP-200" commercially available from Sumitomo Electric Industries, Ltd.) having a pore size of 2 μm to thereby remove insoluble components therefrom, thereby obtaining a sample solution.

(2) Determination of Molecular Weight Distribution

By means of the below-mentioned analyzer, chloroform was allowed to flow therethrough at a rate of 1 mL/min, and a column was stabilized in a thermostat at 40° C. A sample (100 μL) was injected to the column so as to determine the molecular weight distribution of the sample. The molecular weight of the sample was calculated on the basis of a calibration curve prepared in advance. The calibration curve of the molecular weight was prepared by using several kinds of monodisperse polystyrenes (those polystyrenes having weight average molecular weights of $2.63\times10^3$, $2.06\times10^4$, and $1.02\times10^5$ available from Tosoh Corporation; and those polystyrenes having weight average molecular weights of $2.10\times10^3$, $7.00\times10^3$, and $5.04\times10^4$ available from GL Science Co., Ltd.) as standard samples.

Analyzer: CO-8010 (commercially available from Tosoh Corporation)

Column: GMHXL+G3000HXL (commercially available from Tosoh Corporation)

[Softening Point and Glass Transition Point of Resin Particles]

By means of a freeze-dryer (commercially available from Tokyo Rikakikai Co., Ltd., FDU-2100 or DRC-1000), a resin particle dispersion (30 g) was dried in vacuum at −25° C. for one hour, −10° C. for 10 hours, and 25° C. for 4 hours, to thereby adjust the water content to 1% by weight or less.

The water content was determined by means of an infrared water content meter (commercially available from Kett Electric Laboratory, FD-230). Specifically, the water content (% by weight) of a dried sample (5 g) was measured at a drying temperature of 150° C. and in a measurement mode 96 (watch time: 2.5 minutes/variation: 0.05%).

The softening point and glass transition point of the dried particles of the dispersion were measured in the same manner as employed above.

[Volume Median Particle Size ($D_{50}$) and Particle Size Distribution of Colored Particles, Resin Particles, and Releasing Agent Particles]

(1) Measuring Apparatus: Laser diffraction/scattering particle size analyzer ("LA-920" commercially available from HORIBA, Ltd.)

(2) Measuring Conditions: A cell for the measurement was filled with distilled water, and the volume median particle size ($D_{50}$) of the particles was measured at a temperature at which the absorbance thereof fell within an appropriate range. The CV value was calculated according to the following formula:

$$\text{CV Value}(\%)=(\text{Standard Deviation of Particle Size Distribution/Volume Median Particle Size}(D_{50}))\times 100.$$

[Solid Contents of Colored Particle Dispersion and Resin Particle Dispersion]

The solid contents of a colored particle dispersion and a resin particle dispersion were determined by means of an infrared water content meter (commercially available from Kett Electric Laboratory, FD-230). Specifically, the water content (%) of a colored particle or resin particle sample (5 g) was measured at a drying temperature of 150° C. and in a measurement mode 96 (watch time: 2.5 minutes/variation: 0.05%). The solid content was calculated by the following formula:

$$\text{Solid content}(\%\text{ by weight})=100-M$$

M: Water content (%)=$[(W-W_0)/W]\times100$

W: Weight of sample before measurement (initial sample weight)

$W_0$: Weight of sample after measurement (absolutely dry sample weight)

[Volume Median Particle Size ($D_{50}$) and Particle Size Distribution of Toner (Particles), Aggregated Particles, Resin-Particle-Deposited Aggregated Particles, Core/Shell Aggregated Particles, and Coalesced Particles]

The volume median particle size ($D_{50}$) of the toner (particles) was measured in the following manner.

Measuring Apparatus: Coulter Multisizer III (commercially available from Beckman Coulter Inc.)

Aperture Diameter: 50 μm

Analyzing Software: Multisizer III Ver. 3.51 (commercially available from Beckman Coulter Inc.)

Electrolyte Solution: "Isotone II" (commercially available from Beckman Coulter Inc.)

Dispersing Solution: The dispersing solution was prepared by dissolving "EMULGEN 109P" (commercially available from Kao Corporation; polyoxyethylene lauryl ether; HLB: 13.6) in the above electrolyte solution such that the EMULGEN 109P concentration of the obtained solution was adjusted to 5% by weight.

Dispersing Conditions:

A sample (10 mg) to be measured was added to the dispersion (5 mL), and dispersed by means of an ultrasonic disperser for 1 min. Thereafter, an electrolyte solution (25 mL) was added to the dispersion, and the obtained mixture was further dispersed by means of a ultrasonic disperser for 1 min, to thereby prepare a dispersion sample.

Measuring Conditions:

The thus-prepared dispersion sample was added to the electrolyte solution (100 mL). After controlling the concentration of the resultant dispersion such that the determination of 30,000 particles was completed for 20 seconds, the particle sizes of 30,000 particles were measured under such conditions, and the volume median particle size ($D_{50}$) thereof was determined from the particle size distribution.

Meanwhile, the CV value (%) was calculated according to the following formula:

$$\text{CV Value}(\%)=(\text{Standard Deviation of Particle Size Distribution/Volume Average Particle Size}(D_{50}))\times 100.$$

The volume median particle sizes of aggregated particles and core/shell aggregated particles were measured in the same procedure as employed in the measurement of the volume median particle size of the aforementioned toner (particles), except that an aggregated particle dispersion, a resin-particle-deposited aggregated particle dispersion, a core/shell aggregated particle dispersion, and a coalesced particle dispersion were used as dispersion samples.

[BET Specific Surface Area of Toner Particles]

The BET specific surface area was measured by means of Micromeritics FlowSorb III (commercially available from Shimadzu Corporation) under the following conditions.

Amount of toner sample: about 0.1 g (0.09 to 0.11 g)
Degassing conditions: 40° C., 10 minutes
Adsorption gas: nitrogen gas
[Circularity of Core/Shell Particles and Toner Particles]
Preparation of Dispersion: A core/shell particle dispersion sample was prepared to have a core/shell particle solid content of 0.001 to 0.05%, which was adjusted through dilution with deionized water. A toner dispersion was prepared by adding a toner (50 mg) to 5% by weight aqueous solution (5 mL) of "EMULGEN 109P" (commercially available from Kao Corporation; polyoxyethylene lauryl ether), dispersing the toner for one minute by means of an ultrasonic disperser, adding distilled water (20 mL) thereto, and further dispersing the toner for one minute by means of an ultrasonic disperser.
Measuring Apparatus Measuring Apparatus: Flow-type particle image analyzer ("FPIA-3000" available from Sysmex Corp.)
Mode of measurement: HPF measurement mode Resin Production Example 1

Production of Polyester A

Under nitrogen, polyoxypropylene(2.2)-2,2-bis(4-hydroxyphenyl)propane (8,320 g), polyoxyethylene(2.0)-2,2-bis(4-hydroxyphenyl)propane (80 g), terephthalic acid (1,592 g), and dibutyl tin oxide (esterification catalyst) (32 g) were added to a four-neck flask equipped with a nitrogen inlet, a dehydration pipe, a stirrer, and a thermocouple, and the mixture was caused to react under normal pressure (101.3 kPa) at 230° C. for 5 hours, and the reaction was continued under reduced pressure. The reaction mixture was cooled to 210° C., and fumaric acid (1,672 g) and hydroquinone (8 g) were added thereto, followed by performing reaction for 5 hours and continuing the reaction under reduced pressure, to thereby yield polyester A. The polyester A was found to have had a softening point of 110° C., a glass transition point of 66° C., an acid value of 24.4 mg-KOH/g, and a number average molecular weight of 3,760.

Resin Production Example 2

Production of Polyester B

Under nitrogen, polyoxypropylene(2.2)-2,2-bis(4-hydroxyphenyl)propane (1,750 g), polyoxyethylene(2.0)-2,2-bis(4-hydroxyphenyl)propane (1,625 g), terephthalic acid (1,145 g), dodecenylsuccinic anhydride (161 g), trimellitic anhydride (480 g), and tin 2-ethylhexanoate (26 g) were added to a four-neck flask equipped with a nitrogen inlet, a dehydration pipe, a stirrer, and a thermocouple, and the mixture was stirred at 220° C. to cause it to react until the softening point of the product, as measured in accordance with ASTM D36-86, reached 120° C., to thereby yield polyester B. The polyester B was found to have had a softening point of 121° C., a glass transition point of 65° C., an acid value of 21 mg-KOH/g, and a number average molecular weight of 3,390.

Resin Particle Dispersion Production Example 1

Production of Resin Particle Dispersion A

Polyester A (390 g), polyester B (210 g) (the mixture of polyester A and polyester B at the aforementioned ratio exhibiting a softening point of 114° C., a glass transition point of 66° C., and an acid value of 23 mg-KOH/g), a Cu phthalocyanine pigment "ECB301" (available from Dainichiseika Color and Chemicals Mfg. Co., Ltd.) (45 g), an anionic surfactant "NEOPELEX G-15" (sodium dodecylbenzenesulfonate, solid content: 15% by weight, available from Kao Corporation) (40 g), a nonionic surfactant "EMULGEN 430" (polyoxyethylene (26 mol) oleyl ether, HLB: 16.2, available from Kao Corporation) (6 g), and 5% by weight aqueous potassium hydroxide (279 g) were placed in a stainless steel pot (capacity: 5 L), and the mixture stirred at 25° C. by means of a paddle-shaped stirrer at a rate of 200 r/min, to thereby form a dispersion. The contents of the pot were stabilized at 95° C., and maintained for 2 hours while stirring with a paddle-shaped stirrer at a rate of 200 r/min. Subsequently, under stirring with a paddle-shaped stirrer at a rate of 200 r/min, deionized water (1,135 g in total) was added dropwise into the pot at a rate of 6 g/min. During addition of water, the reaction system was maintained at 95° C. Thereafter, the reaction system was cooled to 25° C., to thereby produce a resin particle dispersion in which resin particles were dispersed. The thus-produced resin particle dispersion was found to have a volume median particle size ($D_{50}$) of resin microparticle of 0.17 μm and a solid content of 31.0% by weight.

The thus-produced resin particle dispersion (1,200 g) was placed in a separable flask (capacity: 2 L) and stirred by means of a paddle-shaped stirrer at a rate of 200 r/min. Under stirring, a water-soluble polymer having an oxazoline group (available from Nippon Shokubai Co., Ltd., WS700, oxazoline group content of the polymer: 4.6 mmol/g, number average molecular weight: 20,000, solid content of aqueous solution: 25%) (16.6 g) was added to the dispersion while the aqueous solution was maintained at 25° C. Subsequently, the temperature of the mixture was elevated to 95° C. over 30 minutes, and the mixture was maintained at 95° C. for one hour. Then, the mixture was cooled to 25° C. and caused to pass through a 150-mesh metal gauze (opening: 105 μm), to thereby yield resin particle dispersion A in which cross-linked resin particles were dispersed. The thus-produced resin particle dispersion A was found to have a volume median particle size ($D_{50}$) of cross-linked resin particles of 0.18 μm, a softening point of 116° C., a glass transition point of 58° C., and a solid content of 30.8% by weight. No residual resin components remained on the metal gauze.

Resin Particle Dispersion Production Example 2

Production of Resin Particle Dispersion B

Polyester A (390 g), polyester B (210 g) (the mixture of polyester A and polyester B at the aforementioned ratio exhibiting a softening point of 114° C., a glass transition point of 66° C., and an acid value of 23 mg-KOH/g), an anionic surfactant "NEOPELEX G-15" (sodium dodecylbenzenesulfonate, solid content: 15% by weight, available from Kao Corporation) (40 g), a nonionic surfactant "EMULGEN 430" (polyoxyethylene (26 mol) oleyl ether, HLB: 16.2, available from Kao Corporation) (6 g), and 5% by weight aqueous potassium hydroxide (279 g) were placed in a stainless steel pot (capacity: 5 L), and the mixture stirred at 25° C. by means of a paddle-shaped stirrer at a rate of 200 r/min, to thereby form a dispersion. The contents of the pot were stabilized at 95° C., and maintained for 2 hours while stirring with a paddle-shaped stirrer at a rate of 200 r/min. Subsequently, under stirring with a paddle-shaped stirrer at a rate of 200 r/min, deionized water (1,135 g in total) was added dropwise into the pot at a rate of 6 g/min. During addition of water, the reaction system was maintained at 95° C. Thereafter, the reaction system was cooled to 25° C., to thereby produce resin particle dispersion B in which resin particles were dispersed. The thus-produced resin particle dispersion B was found to have a volume median particle size ($D_{50}$) of resin microparticle of 0.15 μM, a glass transition point of 58° C., a softening point of 105° C., and a solid content of 33.5% by weight.

Releasing Agent Dispersion Production Example 1

Production of Releasing Agent Dispersion A

Aqueous solution of dipotassium alkenyl succinate "LATEMUL ASK" (concentration of effective ingredients: 28%, available from Kao Corp.) (3.75 g) was dissolved in deionized water (400 g) placed in a 1-L beaker. Then, carnauba wax (melting point: 85° C., available from S. Kato & Co.) (100 g) was dispersed in the resultant solution. While the obtained dispersion was maintained at 90 to 95° C., the dispersion was subjected to dispersing treatment for 30 min by means of "Ultrasonic Homogenizer 600W" (available from Nippon Seiki Co., Ltd.), thereby yielding releasing agent dispersion A having a volume median particle size ($D_{50}$) of 0.47 μm and a solid content of 21.4% by weight.

Example 101

Production of Cyan Toner A1

[Step (1)]

Deionized water (269 g) was added to resin particle dispersion A (1,200 g), and deionized water (10.9 g) was added to releasing agent dispersion A (181.7 g). The two liquids were fed to a four-neck flask (capacity: 10 L) equipped with a dehydration pipe, a stirrer, and a thermocouple and mixed at room temperature. Then, while the mixture was stirred by means of a paddle-shaped stirrer, aqueous solution of ammonium sulfate (guaranteed reagent available from Sigma Aldrich Japan Co., Ltd.) (87.1 g) dissolved in deionized water (776.4 g) was added dropwise to the mixture at room temperature over 10 min (Ea: 3.5% by weight). Thereafter, the resultant mixed dispersion was heated to 55° C. to form aggregated particles. The obtained dispersion was maintained at 55° C. until the volume median particle size ($D_{50}$) was adjusted to 4.2 μm, to thereby yield an aggregated particle dispersion containing aggregated particles.

[Step (2)]

The aggregated particle dispersion produced in step (1) was maintained at 55° C., and a mixture of resin particle dispersion B (102.9 g) and deionized water (44 g) was added dropwise to the aggregated particle dispersion at 1.9 g/min. After completion of addition, the resultant mixture was maintained at 55° C. for 20 minutes. This procedure was repeated further four times, to thereby yield a dispersion of resin microparticle-deposited aggregated particles having an aggregating agent concentration Eb of 2.7% by weight.

[Step (3)]

Subsequently, an aqueous solution prepared by diluting aqueous solution of polyoxyethylene (2 mol) dodecyl ether sodium sulfate (solid content: 28% by weight) (93.1 g) with deionized water (7,357 g) was added to the above dispersion, to thereby adjust the aggregating agent concentration (Ec) of the system to 0.81% by weight. The volume median particle size ($D_{50}$) of the resin microparticle-deposited aggregated particles was found to be 4.7 μm.

[Step (4)]

The dispersion (C) of resin microparticle-deposited aggregated particles, whose aggregating agent concentration was adjusted in step (3) was heated to 68° C. over 2 hours, and then maintained at 68° C. for 3 hours, followed by cooling to room temperature. During this procedure, the morphology of the toner was changed from resin microparticle-deposited aggregated particles to coalesced particles. The coalesced particles were found to have a volume median particle size ($D_{50}$) of 4.7 μM.

[Production of Toner Particles]

The dispersion containing coalesced particles was subjected to a suction/filtration step, a washing step, and a drying step, to thereby yield a powder of colored resin particles. In the washing step, while the dispersion containing coalesced particles was centrifuged by means of a centrifugal dehydrating apparatus (available from KOKUSAN Co., Ltd.; centrifugator H-122) at a peripheral speed of 47 m/s (rotating rate: 3,000 rpm, diameter: 30 cm), deionized water was added thereto in an amount of 20±1 L with respect to 100 g of the resin forming the coalesced particles, to thereby wash the particles. Then, the washed particles were further subjected to centrifugation for one hour, to thereby reduce the water content of the powder of colored resin particles. The thus-dehydrated powder was allowed to stand in a vacuum drier maintained at 40° C. for drying the powder of colored resin particles, to thereby produce toner particles.

[Production of Toner]

To the toner particles (100 parts by weight), hydrophobic silica 1 (available from Nippon Aerosil Co., Ltd.; RY50) (2.5 parts by weight), hydrophobic silica 2 (available from Cabot; Cabosil TS720) (1.0 part by weight), and organic microparticles (available from Nippon Paint Co., Ltd.; Finesphere P2000) (0.8 parts by weight) were added by means of a Henschell mixer, to thereby produce cyan toner A1. The cyan toner A1 was found to have a volume median particle size ($D_{50}$) of 4.7 μm.

Examples 102 to 105, and 107 to 109

Production of Cyan Toners B1, C1, D1, E1, G1, H1, and I1

The procedure of Example 101 was repeated, except that, in step (3), the aggregating agent concentration of the system was adjusted to the values specified in Tables 1 and 2 by modifying the polyoxyethylene (2 mol) dodecyl ether sodium sulfate aqueous solution concentration; i.e., the amount of dilution water added to polyoxyethylene (2 mol) dodecyl ether sodium sulfate, and that the coalescing temperature and retention time were adjusted to the values specified in Tables 1 and 2, to thereby produce cyan toners B1, C1, D1, E1, G1, H1, and I1.

Example 106

Production of Cyan Toner F1

The procedure of Example 101 was repeated, except that, in step (2), the number of steps of repeated addition of resin particle dispersion B was changed from 4 times to 9 times; that, in step (3), the aggregating agent concentration of the system was adjusted to the values specified in Tables 1 and 2 by modifying the polyoxyethylene (2 mol) dodecyl ether sodium sulfate aqueous solution concentration; i.e., the amount of dilution water added to polyoxyethylene (2 mol) dodecyl ether sodium sulfate; and that the coalescing temperature and retention time were adjusted to the values specified in Table 1, to thereby produce cyan toner F1.

Comparative Examples 101 to 105

Production of Cyan Toners a K1, L1, N1, and O1

The procedure of Example 101 was repeated, except that, in step (3), the aggregating agent concentration of the system was adjusted to the values specified in Tables 1 and 2 by modifying the polyoxyethylene (2 mol) dodecyl ether sodium sulfate aqueous solution concentration; i.e., the amount of dilution water added to polyoxyethylene (2 mol) dodecyl ether sodium sulfate, and that the coalescing temperature and retention time were adjusted to the values specified in Tables 1 and 2, to thereby produce cyan toners J1, K1, L1, N1, and O1.

The thus-produced cyan toners A1 to L1, N1, and O1 were evaluated through the following tests. Tables 1 and 2 show the results.

[Image-Transferability of Toner]

Each toner was installed in a commercial printer of a non-magnetic single-component development-type (available from Oki Data Corporation, ML5400). In the course of solid image printing, the printing job was stopped. A piece of transparent mending tape (Scotch (registered trademark) Mending Tape 810, available from Sumitomo 3M Limited, width: 18 mm) was affixed onto the surface of the photoreceptor after image-transfer.

The tape piece was removed from the photoreceptor, and this piece and a reference mending tape piece were affixed on a virgin quality paper sheet (available from Oki Data Corporation, Excellent White Paper, A4 size). The paper sheet was stacked on ten sheets of the same paper serving as a base.

The hue of each of the reference tape piece and the tape piece adsorbing a toner remaining after image-transfer was measured by means of a color meter (available from Gretag-Macbeth, SpectroEye, light radiation conditions: standard light source $D_{50}$, observation field 2°, reference to absolute white). The hue was measured at three points in each piece, and the values were arithmetically averaged, to thereby derive the difference in hue (ΔE) according to the following formula:

$$\Delta E=[(L^*_1-L^*_2)^2+(a^*_1-a^*_2)^2+(b^*_1-b^*_2)^2]^{1/2}$$

wherein $L_1$, $a_1$, and $b_1$ are measurements of the reference mending tape piece, and $L_2$, $a_2$, and $b_2$ are measurements of the mending tape piece adsorbing toner on photoreceptor). The smaller the ΔE is, the smaller the amount of remaining toner after image-transfer is. That is, a high-quality image can be reproduced. The results are shown in Table 1.

[Chargeability of Toner]

Under NN conditions (normal temperature and normal humidity conditions, 25° C., 50% RH), each toner (2.1 g) and a silicone-coated ferrite carrier (available from Kanto Denka Kogyo Co., Ltd., mean particle size: 40 μm) (27.9 g) were placed in a 50-cc polypropylene cylindrical bottle (available from Nikko) and shaken ten times in the horizontal and lateral directions, to thereby perform preliminary stirring. Thereafter, the mixture was mixed by means of a TURBULA mixer for one hour, and the charging amount of the mixture was measured by means of a q/m meter (available from EPPING), to thereby determine the charging amount under NN conditions (NN charging amount).

Measurement apparatus: available from EPPING, q/m-meter

Conditions:

Mesh size: 635 mesh (opening: 24 μm, stainless steel)

Soft Blow

Blow voltage (600 V)

Suction time: 90 seconds

Charging amount (μC/g)=total electric charge (μC) after 90 seconds/amount of collected toner (g)

After completion of measurement, the aforementioned developer was maintained under HH conditions (high temperature and high humidity conditions, 30° C., 85% RH) for 12 hours. Subsequently, the developer was removed from the HH conditions and further stirred by means of a TURBULA mixer for one hour. Then, the charging amount was measured again, to thereby obtain the charging amount under HH conditions (HH charging amount).

(Evaluation of Absolute Value of Charging Amount)

Good: 40 or larger and smaller than 50

Practical level: 30 or larger and smaller than 40

Bad: smaller than 30

[Percent Retention of Charging Amount of Toner]

The percent retention of charging amount was calculated by the following formula from the charging amount values measured under various conditions.

Percent retention of charging amount(%)=(*HH* charging amount/*NN* charging amount)×100

A percent retention of approximately 100% was evaluated as good retention in electric charge.

[Evaluation of Toner Cloud]

Under NN conditions (25° C., 50% RH), each toner (0.7 g) and a silicone ferrite carrier (available from Kanto Denka Kogyo Co., Ltd., mean particle size: 40 μm) (9.3 g) were placed in a 20-mL polypropylene cylindrical bottle (available from Nikko) and shaken ten times in the horizontal and lateral directions. The mixture was further stirred for 10 minutes.

A development roller (diameter: 42 mm) installed in a commercial printer was removed, and a rotatable external development roller apparatus was fabricated therefrom. The development roller of the thus-fabricated apparatus was rotated at 10 rpm, and a developer was deposited on the roller over a width of 3 to 8 cm. After uniform deposition of the developer, the rotation was paused. Then, the development roller was rotated at 45 rpm, and the number of toner particles flying during rotation for 1 minute was counted by means of a DIGITAL DUST INDICATOR MODEL P-5 (available from Shibata Scientific Technology Ltd.).

The toner cloud was evaluated on the basis of the number of flying particles. The smaller the number of particles is, the lower the toner cloud generates.

[Evaluation of Storage Stability of Toner]

Each toner (10 g) was placed in a polymer bottle (capacity: 20 mL) and was allowed to stand for 48 hours under given conditions (55° C., 40 RH %) with the cap of the bottle being opened. Thereafter, the degree of aggregation was measured by means of a powder tester (available from Hosokawa Micron), and the storage stability of the toner was evaluated based on the following ratings. The smaller the degree of aggregation is, the more excellent the storage stability of the toner is.

A: percent aggregation lower than 10%

B: percent aggregation of 10% or higher and lower than 20%

C: percent aggregation of 20% or higher

Specifically, the percent aggregation was determined by means of the powder tester in the following manner.

Three sieves having different opening sizes were placed on a vibration table of the powder tester (upper: 250 μm, middle: 150 μm, lower: 75 μm). A toner (2 g) was placed in the upper sieve and vibrated for 60 seconds. The weight of toner remaining on each sieve was measured. From the measurements of the weight of toner, the percent aggregation [%] was determined by the following formula.

Percent aggregation[%]=$a+b+c$ $a$=(weight of toner remaining on upper sieve)/2 [g]×100

$b$=(weight of toner remaining on middle sieve)/2 [g]×100×(3/5)

$c$=(weight of toner remaining on lower sieve)/2 [g]×100×(1/5)

TABLE 1

| | | Ex. 101 | Ex. 102 | Ex. 103 | Ex. 104 | Ex. 105 | Comp. Ex. 101 | Comp. Ex. 102 | Comp. Ex. 103 | Ref. Ex. 101 |
|---|---|---|---|---|---|---|---|---|---|---|
| Toners | | A1 | B1 | C1 | D1 | E1 | J1 | K1 | L1 | M1 |
| Ea (wt %) (step 1) | | 3.5 | 3.5 | 3.5 | 3.5 | 3.5 | 3.5 | 3.5 | 3.5 | 3.5 |
| Eb (wt %) (step 2) | | 2.7 | 2.7 | 2.7 | 2.7 | 2.1 | 2.7 | 2.7 | 2.7 | 2.7 |
| Eb/Ea | | 0.77 | 0.77 | 0.77 | 0.77 | 0.60 | 0.77 | 0.77 | 0.77 | 0.77 |
| Ec (wt %) (step 3) | | 0.81 | 0.98 | 0.4 | 0.29 | 0.4 | 1.24 | 1.24 | 0.01 | 0.25 |
| Ec/Ea | | 0.23 | 0.28 | 0.11 | 0.081 | 0.11 | 0.35 | 0.35 | 0.004 | 0.072 |
| (a) Tg (° C.) of resin microparticles | | 58 | 58 | 58 | 58 | 58 | 58 | 58 | 58 | 58 |
| M.p. (° C.) of releasing agent particles | | 83 | 83 | 83 | 83 | 83 | 83 | 83 | 83 | 83 |
| (b) Temp. (° C.) in step 4 | | 68 | 68 | 68 | 62 | 68 | 68 | 80 | 68 | 68 |
| (b) − (a) (° C.) | | 10 | 10 | 10 | 4 | 10 | 10 | 22 | 10 | 10 |
| Heating time (step 4) (hr) | | 3 | 3 | 3 | 12 | 3 | 3 | 1 | 1 | 1 |
| Toner characteristics | Particle size (μm) | 4.7 | 4.8 | 4.8 | 4.9 | 5.1 | 4.9 | 5 | 5.2 | 4.8 |
| | Circularity | 0.962 | 0.960 | 0.967 | 0.965 | 0.966 | 0.957 | 0.962 | 0.982 | 0.974 |
| | BET ($m^2$/g) | 3.7 | 4.0 | 3.1 | 4.1 | 3.5 | 6.3 | 3.7 | 2.8 | 2.8 |
| Toner evaluation | Storage stability | A | A | A | A | A | C | A | A | A |
| | HH charge/NN charge (%) | 71 | 65 | 77 | 72 | 73 | 63 | 51 | 73 | 71 |
| | NN charge (−μC/g) | 46.3 | 46.8 | 42 | 50.4 | 47.4 | 30.5 | 36.5 | 33.5 | 37.1 |
| | HH charge (−μC/g) | 32.8 | 30.4 | 32.2 | 36.5 | 34.5 | 19.3 | 18.5 | 24.5 | 26.5 |
| | Flying particles | 39 | 45 | 32 | 38 | 38 | 1690 | 46 | 145 | 82 |

TABLE 2

| | | Ex. 106 | Ex. 107 | Ex. 108 | Ex. 109 | Comp. Ex. 104 | Comp. Ex. 105 | Ref. Ex. 102 |
|---|---|---|---|---|---|---|---|---|
| Toners | | F1 | G1 | H1 | I1 | N1 | O1 | P1 |
| Ea (wt %) (step 1) | | 3.5 | 3.5 | 3.5 | 3.5 | 3.5 | 3.5 | 3.5 |
| Eb (wt %) (step 2) | | 2.7 | 2.7 | 2.7 | 2.7 | 2.7 | 2.7 | 2.7 |
| Eb/Ea | | 0.77 | 0.77 | 0.77 | 0.77 | 0.77 | 0.77 | 0.77 |
| Ec (wt %) (step 3) | | 0.09 | 0.28 | 0.09 | 0.023 | 1.24 | 1.24 | 0.31 |
| Ec/Ea | | 0.026 | 0.080 | 0.026 | 0.007 | 0.35 | 0.35 | 0.087 |
| (a) Tg (° C.) of resin microparticles | | 58 | 58 | 58 | 58 | 58 | 58 | 58 |
| M.p. (° C.) of releasing agent particles | | 83 | 83 | 83 | 83 | 83 | 83 | 83 |
| (b) Temp. (° C.) in step 4 | | 73 | 73 | 68 | 63 | 88 | 73 | 76 |
| (b) − (a) (° C.) | | 15 | 15 | 10 | 5 | 30 | 15 | 18 |
| Heating time (step 4) (hr) | | 4 | 4 | 6 | 18 | 4 | 4 | 4 |
| Toner characteristics | Particle size (μm) | 4.8 | 4.9 | 4.9 | 4.9 | 5.0 | 4.9 | 4.9 |
| | Circularity | 0.984 | 0.981 | 0.983 | 0.980 | 0.982 | 0.952 | 0.978 |
| | BET ($m^2$/g) | 2.6 | 2.8 | 2.7 | 2.6 | 2.7 | 6.1 | 3.3 |
| Toner evaluation | Storage stability | A | A | A | A | B | C | A |
| | Transfer remaining (ΔE) | 3.4 | 4.2 | 2.8 | 2.2 | 8.2 | 12.4 | 5.0 |

As is clear from Table 1, the first embodiment of the present invention enables provision of a process for producing a toner for electrophotography which exhibits improved storage stability, tribocharge stability in the environment, and low incidence of toner cloud (Examples 101 to 105). As is clear from Table 2, the second embodiment of the present invention enables provision of a process for producing a toner for electrophotography which exhibits improved storage stability and image-transferability (Examples 106 to 109).

Production Example 201

Production of Crystalline Polyester (1)

The inside of a four-neck flask equipped with a nitrogen inlet, a dehydration pipe, a stirrer, and a thermocouple was substituted by nitrogen, and 1,9-nonandiol (3,936 g) and sebacic acid (4,848 g) were added to the flakes. The mixture was heated to 140° C. under stirring and maintained at 140° C. for 3 hours. Then, the mixture was heated from 140° C. to 200° C. over 10 hours. Thereafter, tin dioctanoate (50 g) was added to the mixture and maintained at 200° C. for one hour. The inside pressure of the flask was then reduced, and the mixture was maintained at 8.3 kPa for 4 hours, to thereby yield crystalline polyester (1). The crystalline polyester (1) was found to have a melting point of 72° C., a crystallinity index of 1.1, an acid value of 3.1 mg-KOH/g, and a number average molecular weight of $6.1\times10^3$.

Production Example 202

Production of Amorphous Polyester (1)

The inside of a four-neck flask equipped with a nitrogen inlet, a dehydration pipe, a stirrer, and a thermocouple was substituted by nitrogen, and polyoxypropylene(2.2)-2,2-bis(4-hydroxyphenyl)propane (1,750 g), polyoxyethylene(2.0)-2,2-bis(4-hydroxyphenyl)propane (1,625 g), terephthalic acid (1,145 g), dodecenylsuccinic anhydride (161 g), trimellitic anhydride (480 g), and dibutyl tin oxide (10 g) were added to the flask. Under nitrogen and stirring, the mixture was heated to 220° C. and maintained at 220° C. for 5 hours. Thereafter, when the softening point as measured in accordance with ASTM D36-86 reached 120° C., the temperature was lowered so as to terminate reaction, to thereby yield amorphous polyester (1). The amorphous polyester (1) was found to have a glass transition point of 65° C., a softening point of 122° C., a crystallinity index of 1.6, an acid value of 21.0 mg-KOH/g, and a number average molecular weight of $2.9\times10^3$.

Production Example 203

Production of Amorphous Polyester (2)

The inside of a four-neck flask equipped with a nitrogen inlet, a dehydration pipe, a stirrer, and a thermocouple was substituted by nitrogen, and polyoxypropylene(2.2)-2,2-bis(4-hydroxyphenyl)propane (3,374 g), polyoxyethylene(2.0)-2,2-bis(4-hydroxyphenyl)propane (33 g), terephthalic acid (672 g), and dibutyl tin oxide (10 g) were added to the flask. Under nitrogen and stirring, the mixture was heated to 230° C. and maintained at 220° C. for 5 hours. Thereafter, the inside pressure of the flask was reduced, and the mixture was maintained at 8.3 kPa for one hour. Then, the mixture was cooled to 210° C. and returned to the atmosphere. Fumaric acid (696 g) and tert-butylcatecohol (0.49 g) were added to the mixture, and the resultant mixture was maintained at 210° C. for 5 hours. The inside pressure of the flask was further reduced, and the mixture was maintained at 8.3 kPa for 4 hours, to thereby yield amorphous polyester (2). The amorphous polyester (2) was found to have a glass transition point of 65° C., a softening point of 107° C., a crystallinity index of 1.5, an acid value of 24.4 mg-KOH/g, and a number average molecular weight of $3.0\times10^3$.

Production Example 204

Production of Dispersion of Colorant-Containing Resin Particles (A)

To a flask equipped with a stirrer, crystalline polyester (1) (90 g), amorphous polyester (1) (210 g), amorphous polyester (2) (300 g), a Cu phthalocyanine pigment "ECB301" (available from Dainichiseika Color and Chemicals Mfg. Co., Ltd.) (45 g), polyoxyethylene alkyl ether (nonionic surfactant, EMULGEN 150, available from Kao Corporation) (8.5 g), 15% by weight aqueous sodium dodecylbenzenesulfonate (anionic surfactant, NEOPELEX G-15, available from Kao Corporation) (80 g), and 5% by weight aqueous potassium hydroxide (235 g) added. Under stirring, the mixture was heated to 98° C. to melt the mixture, and the molten mixture was mixed at 98° C. for 2 hours, to thereby produce a resin mixture.

Subsequently, deionized water (1,146 g) was added dropwise to the mixture at 6 g/min under stirring, to thereby form an emulsion. The thus-formed emulsion was cooled to 25° C. and caused to pass through a 200-mesh metal gauze (opening: 105 μm), to thereby yield dispersion of colorant-containing resin particles (A). The thus-obtained dispersion was found to have a solid content of 32% by weight, a volume median particle size of resin particles (A) of 0.227 μn, and a CV value of 27%.

Production Example 205

Production of Dispersion of Amorphous-Polyester-Containing Resin Particles (B)

To a flask (capacity: 5 L), amorphous polyester (1) (210 g), amorphous polyester (2) (390 g), polyoxyethylene alkyl ether (nonionic surfactant, EMULGEN 430, available from Kao Corporation) (6 g), 15% by weight aqueous sodium dodecylbenzenesulfonate (anionic surfactant, NEOPELEX G-15, available from Kao Corporation) (40 g), and 5% by weight aqueous potassium hydroxide (268 g) added. Under stirring, the mixture was heated to 95° C. to melt the mixture, and the molten mixture was mixed at 95° C. for 2 hours, to thereby produce a resin mixture.

Subsequently, deionized water (1,145 g) was added dropwise to the mixture at 6 g/min under stirring, to thereby form an emulsion. The thus-formed emulsion was cooled to 25° C. and caused to pass through a 200-mesh metal gauze, and deionized water was added to the filtrate, to thereby adjust the solid content to 23% by weight, whereby dispersion of amorphous-polyester-containing resin particles (B) is yielded. The dispersion was found to have a volume median particle size of resin particles (B) of 0.158 μm, a CV value of 24%, and a glass transition temperature of 60° C.

Production Example 206

Production of Dispersion of Releasing-Agent-Containing Particles

Deionized water (480 g), aqueous solution of dipotassium alkenyl (mixture of hexadecenyl and octadecenyl) succinate "LATEMUL ASK" (concentration of effective ingredients: 28% by weight, available from Kao Corp.) (4.29 g), and carnauba wax (melting point: 85° C., acid value: 5 mg-KOH/g, available from S. Kato & Co.) (120 g) were placed in a 1-L beaker and stirred. Then, while the mixture was maintained at 90 to 95° C., the mixture was subjected to dispersing treatment for 30 min by means of "Ultrasonic Homogenizer 600W" (available from Nippon Seiki Co., Ltd.), and cooled to 25° C. The solid content of the mixture was adjusted to 20% by weight with deionized water, to thereby yield a releasing agent dispersion. The releasing agent particles were found to have a volume median particle size ($D_{50}$) of 0.494 nm and a CV value of 34%.

Example 201

Production of Toner A2

<Production of Core-Aggregated Particle Dispersion>

To a four-neck flask (capacity: 10 L) equipped with a dehydration pipe, a stirrer, and a thermocouple, dispersion of colorant-containing resin particles (A) (1,000 g), deionized water (275 g), and the dispersion of releasing agent particles (169 g) were added, and the mixture was mixed at 25° C. Subsequently, when the mixture was stirred, aqueous solution of ammonium sulfate (84 g) dissolved in deionized water (879 g) was added to the mixture at 25° C. for 10 minutes. The resultant mixture was heated to 48° C., and maintained at 48° C. until the volume median particle size of the aggregated particles reached 4.3 μm, to thereby yield a core-aggregated particle dispersion.

<Production of Core/Shell Particle Dispersion (1) (Step (3-1))>

The above-produced core-aggregated particle dispersion was maintained at 48° C., and the dispersion (255 g) of amorphous-polyester-containing resin particles (B) was added thereto at 1.4 g/min. After completion of addition, the mixture was heated to 55° C. over 4 hours, and the dispersion (383 g) of amorphous-polyester-containing resin particles (B) was further added thereto at 1.4 g/min. After completion of second addition, the temperature of the mixture was 55° C. Subsequently, the dispersion was cooled to 25° C.

To the thus-obtained dispersion, aqueous solution of alkyl ether sodium sulfate (anionic surfactant, Emal E27C, available from Kao Corp., solid content: 28%) (81 g) dissolved in deionized water (6,385 g) was added. The mixture was heated to 60° C. over 1.5 hours and maintained at 60° C. for 2 hours, to thereby form core/shell particle dispersion (1). The dispersion system was found to have an aggregating agent concentration of 0.17 mol/L, and the formed core/shell particles (1) were found to have a circularity of 0.948.

<Production of Dispersion of Resin Microparticle-Deposited Aggregated Particles (C) (Step (3-2))>

The core/shell particle dispersion (1) produced in step (3-1) was cooled to 25° C. A Buchner funnel was attached to a 10-L suction pot, and a filter paper (diameter: 285 mm) (available from TGK, circular quantitative filter paper #2) was placed on the Buchner funnel. The core/shell particle dispersion (1) was subjected to suction filtration under recued pressure, to thereby remove a filtrate; i.e., an aqueous medium containing an aggregating agent, whereby a slurry having a solid content of 37% was recovered. To the slurry (1,433 g), deionized water (25° C.) was added so as to adjust the total weight to 3,042 g. Then, aqueous solution of alkyl ether sodium sulfate (anionic surfactant, Emal E27C, available from Kao Corp., solid content: 28%) (81 g) dissolved in deionized water (6,385 g) was added to the slurry, and the mixture was stirred at 25° C. by means of a stirrer (step (3a)).

Separately, the dispersion produced in step (3a) was subjected to suction filtration, to thereby recover a slurry having a solid content of 37%. To the slurry (1,433 g), deionized water (25° C.) was added so as to adjust the total weight to 3,042 g. Then, aqueous solution of alkyl ether sodium sulfate (anionic surfactant, Emal E27C, available from Kao Corp., solid content: 28%) (81 g) dissolved in deionized water (6,385 g) was added to the slurry, and the mixture was stirred at 25° C., to thereby yield dispersion (C) of resin microparticle-deposited aggregated particles having an aggregating agent concentration Ec of 0.0039 mol/L (step (3b)).

<Step (4): Production of Core/Shell Particle Dispersion (3)>

The dispersion (C) of resin microparticle-deposited aggregated particles produced in step (3-2) was heated to 60° C. for one hour and maintained at 60° C. Heating was continued until the circularity reached 0.959, and then the dispersion was cooled to 25° C., to thereby yield core/shell particle dispersion (3).

<Post-Treatment Step>

The thus-produced core/shell particle dispersion (3) was subjected to suction filtration, washed with deionized water, and dried at 33° C., to thereby produce toner particles. The toner particles (100 parts by weight), hydrophobic silica (available from Nippon Aerosil Co., Ltd.; RY50, mean particle size: 0.04 μm) (2.5 parts by weight), and hydrophobic silica (available from Cabot Corporation; CAB-O-SIL TS720, mean particle size 0.012 μm) (1.0 part by weight) were placed in and stirred by means of a Henschel mixer, and the mixture was caused to pass through a 150-mesh sieve, to thereby produce toner A2. The toner A2 was found to have a volume median particle size ($D_{50}$) of 5.1 μm and a 52 μm fractional ratio of 3.2% (number of particles).

Examples 204 and 205

Production of Toners D2 and E2

The procedure of Example 201 was repeated, except that the amount of deionized water employed in step (3-1) was modified so as to adjust the aggregating agent concentration of the dispersion (C) of resin microparticle-deposited aggregated particles to the values shown in Table 3, to thereby produce toners D2 and E2.

Examples 204 and 205

Production of Toners D and E

The procedure of Example 201 was repeated, except that the amount of deionized water employed in step (3-1) was modified so as to adjust the aggregating agent concentration of the dispersion (C) of resin microparticle-deposited aggregated particles to the values shown in Table 3, to thereby produce toners D2 and E2.

Example 206

Production of Toner F2

The procedure of Example 201 was repeated, except that no alkyl ether sodium sulfate (anionic surfactant, Emal E27C, available from Kao Corp.) was used in step (3-2), to thereby produce toner F2.

Comparative Example 201

Production of Toner G2

The procedure of Example 201 was repeated, except that steps (3-2) and (4) were not performed after completion of step (3-1). The produced core/shell particle dispersion was subjected to suction filtration, washed with deionized water, and dried at 33° C., to thereby produce toner particles. The toner particles (100 parts by weight), hydrophobic silica (available from Nippon Aerosil Co., Ltd.; RY50, mean particle size: 0.04 μm) (2.5 parts by weight), and hydrophobic silica (available from Cabot; Cabosil TS720, mean particle size 0.012 μm) (1.0 part by weight) were placed in and stirred by means of a Henschel mixer, and the mixture was caused to pass through a 150-mesh sieve, to thereby produce toner G2. The toner G2 was found to have a volume median particle size ($D_{50}$) of 5.0 μm and a ≤2 μm fractional ratio of 4.2% (number of particles).

Reference Examples 201 and 202

Production of Toners H2 and 12

The procedure of Example 201 was repeated, except that the amount of deionized water employed in step (3-1) was modified so as to adjust the aggregating agent concentration of the core/shell particle dispersion (1) to the values shown in Table 3, and no alkyl ether sodium sulfate (anionic surfactant, Emal E27C, available from Kao Corp.) was used in step (3-2), to thereby produce toners H2 and I2.

Reference Example 203

Production of Toner J2

The procedure of Example 201 was repeated, except that no alkyl ether sodium sulfate (anionic surfactant, Emal E27C, available from Kao Corp.) was used in step (3-2), and that the amount of deionized water was modified so as to adjust the aggregating agent concentration of the dispersion (C) of to the values shown in Table 3, and to thereby produce toner J2.

Comparative Example 202

Production of Toner K2

The procedure of step (3-1) of Example 201 was repeated, except that aqueous solution of alkyl ether sodium sulfate (anionic surfactant, Emal E27C, available from Kao Corp.) (81 g) dissolved in deionized water (6,385 g) was added to the slurry, and the mixture was stirred. After stirring, the mixture was heated to 77° C. over 2 hours. After the temperature had reached 77° C., the mixture was cooled to 25° C. After cooling, the mixture was subjected to suction filtration, washed with deionized water, and dried at 33° C., to thereby produce toner particles. The toner particles (100 parts by weight), hydrophobic silica (available from Nippon Aerosil Co., Ltd.; RY50) (2.5 parts by weight), and hydrophobic silica (available from Cabot Corporation; CAB-O-SIL TS720) (1.0 part by weight) were placed in and stirred by means of a Henschel mixer, and the mixture was caused to pass through a 150-mesh sieve, to thereby produce toner K2.

The thus-produced toners A2 to K2 were evaluated in the following manner. Table 4 shows the results.

[Evaluation of Low-Temperature Fusing Ability of Toner]

A solid image was printed on a quality paper sheet (available from Fuji Xerox Co., Ltd., J paper, size: A4) by means of a commercial printer (available from Oki Data Corporation, ML5400) such that the amount of deposited toner was adjusted to 0.42 to 0.48 mg/cm$^2$. A non-printed area was provided from the top (0 mm) of the paper sheet to 5 mm, and a solid image of a 50-mm length was output without fusing.

Subsequently, a printer in which a fuser had been rendered temperature-controllable was provided. The solid image printed on each A4 paper sheet was fused by means of the fuser at 100° C. and a fusing rate of one sheet/1.5 sec in the longitudinal direction, to thereby obtain a printed product.

In a similar manner, fusing was carried out at stepwise elevated temperatures (by 5° C.) of the fuser, to thereby obtain printed products.

Onto the non-printed area printed image provided at the top of the printed sheet, a cut piece of mending tape (Scotch Mending Tape 810, available from Sumitomo 3M Limited, width: 18 mm) having a length of 50 mm was lightly affixed. A weight (500 g) was pressed against the tape cut piece and reciprocated once on the piece at a rate of 10 mm/second. Thereafter, the affixed tape piece was peeled off from the bottom edge at a peeling angle of 180° and a rate of 10 mm/second, to thereby obtain a tape-peeled printed product. Each of the printed sheets before affixing the tape and after removing the tape was stacked on 30 sheets of quality paper (available from Oki Data Corporation, Excellent White Paper, A4 size). The reflection image density of a fused image area of each printed sheet (before affixing the tape and after removing the tape) was measured by means of a color meter (available from GretagMacbeth, SpectroEye, light radiation conditions: standard light source $D_{50}$, observation field 2°, density reference DINNB, and reference to absolute white). Percent of fusing was calculated from these measurements by the following formula:

Percent of fusing=(reflection image density after peeling tape/reflection image density before affixing tape)×100.

The temperature at which a percent of fusing of 90 or higher was obtained was employed as the lowest fusing temperature. The lower the lowest fusing temperature is, the more excellent the low-temperature fusing ability is.

[Evaluation of Storage Stability of Toner]

Each toner (10 g) was placed in a polypropylene cylindrical bottle (available from Nikko) (capacity: 20 mL) and was allowed to stand for 12 hours under given conditions (50° C., 40 RH %) with the cap of the bottle being opened. Three sieves having different opening sizes were placed on a vibration table of a powder tester (available from Hosokawa Micron Corporation) (upper: 250 μm, middle: 150 μm, lower: 75 μm). A toner (2 g) was placed in the upper sieve and vibrated for 60 seconds. The weight of toner remaining on each sieve was measured. From the measurements of the weight of toner, the percent aggregation [%] was determined by the following formula.

Percent aggregation[%]=$a+b+c$ $a$=(weight of toner remaining on upper sieve)/2 [g]×100

$b$=(weight of toner remaining on middle sieve)/2 [g]×100×(3/5)

$c$=(weight of toner remaining on lower sieve)/2 [g]×100×(1/5)

The smaller the degree of aggregation is, the more excellent the storage stability of the toner is.

[Evaluation of Toner Cloud]

The same evaluation method as employed in Example 101 was employed.

TABLE 3

| | | | Ex. 201 | Ex. 202 | Ex. 203 | Ex. 204 | Ex. 205 | Ex. 206 |
|---|---|---|---|---|---|---|---|---|
| Dispersion of colorant resin particles (A) | Resin property | M.p. (° C.) of cryst. polyester (1) | 72 | 72 | 72 | 72 | 72 | 72 |
| Dispersion of releasing agent | Releasing agent property | M.p. (° C.) of releasing agent | 85 | 85 | 85 | 85 | 85 | 85 |
| Dispersion of resin particles (B) | Resin property | Tg (° C.) of amorphous polyester | 65 | 65 | 65 | 65 | 65 | 65 |
| | | Tg (° C.) of resin particles | 60 | 60 | 60 | 60 | 60 | 60 |
| Production conditions | Step (1) | Ea (wt %) (step 1) | 3.5 | 3.5 | 3.5 | 3.5 | 3.5 | 3.5 |
| | Step (2) | Eb (wt %) (step 2) | 2.7 | 2.7 | 2.7 | 2.7 | 2.7 | 2.7 |

TABLE 3-continued

| | | | | | | | | |
|---|---|---|---|---|---|---|---|---|
| | | Eb/Ea | 0.77 | 0.77 | 0.77 | 0.77 | 0.77 | 0.77 |
| | Step (3-1) | Tmax (° C.) in the step | 60 | 60 | 60 | 60 | 60 | 60 |
| | | Aggregating agent concn. (mol/L) of dispersion (1) | 0.17 | 0.34 | 0.08 | 0.17 | 0.17 | 0.17 |
| | | Circularity of core/shell particles | 0.948 | 0.946 | 0.956 | 0.948 | 0.948 | 0.948 |
| | Step (3-2) | Removal of aggregating agent | yes | yes | yes | yes | yes | yes |
| | | Addition of aq. medium | yes aq. ES | yes aq. ES | yes aq. ES | yes aq. ES | yes aq. ES | yes water solo |
| | | Aggregating agent concn. (mol/L) of dispersion (C) | 0.0039 | 0.0039 | 0.0039 | 0.026 | 0.000002 | 0.0039 |
| | | Ec (wt %) | 0.026 | 0.026 | 0.026 | 0.17 | 0.00001 | 0.026 |
| | | Ec/Ea | 0.0074 | 0.0074 | 0.0074 | 0.0486 | 0.000003 | 0.0074 |
| | Step (4) | Tmax (° C.) in the step | 60 | 60 | 60 | 60 | 60 | 60 |
| | | Circularity of core/shell particles | 0.959 | 0.958 | 0.966 | 0.958 | 0.965 | 0.959 |
| | | Circularity difference between step (4) and step (3-1) | 0.011 | 0.012 | 0.010 | 0.010 | 0.017 | 0.011 |

| | | | Comp. Ex. 201 | Comp. Ex. 202 | Ref. Ex. 201 | Ref. Ex. 202 | Ref. Ex. 203 |
|---|---|---|---|---|---|---|---|
| Dispersion of colorant resin particles (A) | Resin property | M.p. (° C.) of cryst. polyester (1) | 72 | 72 | 72 | 72 | 72 |
| Dispersion of releasing agent | Releasing agent property | M.p. (° C.) of releasing agent | 85 | 85 | 85 | 85 | 85 |
| Dispersion of resin particles (B) | Resin property | Tg (° C.) of amorphous polyester | 65 | 65 | 65 | 65 | 65 |
| | | Tg (° C.) of resin particles | 60 | 60 | 60 | 60 | 60 |
| Production conditions | Step (1) | Ea (wt %) (step 1) | 3.5 | 3.5 | 3.5 | 3.5 | 3.5 |
| | Step (2) | Eb (wt %) (step 2) | 2.7 | 2.7 | 2.7 | 2.7 | 2.7 |
| | | Eb/Ea | 0.77 | 0.77 | 0.77 | 0.77 | 0.77 |
| | Step (3-1) | Tmax (° C.) in the step | 60 | 77 | 60 | 60 | 60 |
| | | Aggregating agent concn. (mol/L) of dispersion (1) | 0.17 | 0.17 | 0.50 | 0.04 | 0.17 |
| | | Circularity of core/shell particles | 0.948 | 0.974 | 0.944 | 0.970 | 0.948 |
| | Step (3-2) | Removal of aggregating agent | no | no | yes | yes | yes |
| | | Addition of aq. medium | no | no | yes water solo | yes water solo | yes water solo |
| | | Aggregating agent concn. (mol/L) of dispersion (C) | — | — | 0.0039 | 0.0039 | 0.06 |
| | | Ec (wt %) | — | — | 0.026 | 0.026 | 0.38 |
| | | Ec/Ea | — | — | 0.0074 | 0.0074 | 0.1086 |
| | Step (4) | Tmax (° C.) in the step | — | — | 60 | 60 | 60 |
| | | Circularity of core/shell particles | — | — | 0.958 | 0.982 | 0.954 |
| | | Circularity difference between step (4) and step (3-1) | — | — | 0.014 | 0.012 | 0.006 |

aq. ES: alkyl ether Na sulfate aqueous solution

TABLE 4

| | | | Ex. 201 | Ex. 202 | Ex. 203 | Ex. 204 | Ex. 205 | Ex. 206 |
|---|---|---|---|---|---|---|---|---|
| Toner | | | A2 | B2 | C2 | D2 | E2 | F2 |
| Toner properties | Circularity | | 0.959 | 0.958 | 0.968 | 0.958 | 0.967 | 0.959 |
| | BET ($m^2/g$) | | 2.6 | 2.4 | 2.2 | 3.9 | 2.0 | 1.9 |
| | Volume median particle size $D_{50}$ (μm) | | 5.1 | 5.0 | 5.0 | 5.1 | 5.0 | 4.9 |
| | ≤2 μm particles (%) | | 3.2 | 4.8 | 3.1 | 3.2 | 3.0 | 3.2 |
| Toner evaluation | Low-temp. fusing ability | Min. fixation temperature (° C.) | 120 | 120 | 120 | 120 | 120 | 120 |
| | Storage stability | Percent aggregation (%) | 3.4 | 6.2 | 2.8 | 9.2 | 2.2 | 1.8 |
| | Toner cloud | Flying particles | 88 | 122 | 112 | 164 | 148 | 80 |

| | | | Comp. Ex. 201 | Comp. Ex. 202 | Ref. Ex. 201 | Ref. Ex. 202 | Ref. Ex. 203 |
|---|---|---|---|---|---|---|---|
| Toner | | | G2 | K2 | H2 | I2 | J2 |
| Toner properties | Circularity | | 0.948 | 0.974 | 0.958 | 0.982 | 0.954 |
| | BET ($m^2/g$) | | 6.7 | 1.8 | 2.4 | 2.0 | 5.5 |
| | Volume median particle size $D_{50}$ (μm) | | 5.0 | 5.0 | 4.9 | 5.0 | 5.1 |
| | ≤2 μm particles (%) | | 4.2 | 6.2 | 9.8 | 3.7 | 3.5 |
| Toner evaluation | Low-temp. fusing ability | Min. fixation temperature (° C.) | 120 | 120 | 120 | 120 | 120 |
| | Storage stability | Percent aggregation (%) | 32 | 56 | 14 | 2.9 | 18 |
| | Toner cloud | Flying particles | 225 | 852 | 200 | 450 | 133 |

As is clear from Table 4, toners for electrophotography which fall within the scope of the present invention and which had been produced through the process for producing a toner for electrophotography according to the third embodiment of the present invention exhibited excellent storage stability without impairing low-temperature fusing ability, as compared with the toners falling outside the scope of the invention. Thus, the toners according to the third embodiment of the present invention are excellent in low-temperature fusing ability and storage stability and prevent toner cloud (Examples 201 to 206).

INDUSTRIAL APPLICABILITY

The production process of the present invention enables provision of toners for use in a variety of applications. The toner of the present invention for electrophotography can be suitably used an electrophotographic method, an electrostatic recording method, an electrostatic printing method or the like.

The invention claimed is:

1. A process for producing a toner for electrophotography comprising:

(1) adding an aggregating agent to a resin particle dispersion (a) so as to attain an aggregating agent concentration Ea (% by weight), to thereby aggregate resin particles in the resin particle dispersion (a), whereby an aggregated particle dispersion (A) is produced;

(2) adding a resin microparticle dispersion (b) to the aggregated particle dispersion (A) produced in said (1) adding, to thereby produce a dispersion (B) of resin microparticle-deposited aggregated particles having an aggregating agent concentration Eb (% by weight) satisfying formula 1:

$$0.60 \leq Eb/Ea < 1 \quad \text{(formula 1);}$$

(3) modifying the aggregating agent concentration of the dispersion (B) of resin microparticle-deposited aggregated particles produced in said (2) adding, to thereby produce a dispersion (C) of resin microparticle-deposited aggregated particles, having an aggregating agent concentration Ec (% by weight) satisfying formula 2-A:

$$0.005 \leq Ec/Ea \leq 0.30 \quad \text{(formula 2-A); and}$$

(4) heating the resin microparticle-deposited aggregated particles in the dispersion (C) of resin microparticle-deposited aggregated particles having the aggregating agent concentration Ec and produced in said (3) modifying at a temperature falling within a range between a glass transition point Tg (° C.) of the resin microparticles in the resin microparticle dispersion (b) and (Tg+20) (° C.), to thereby coalesce the aggregated particles.

2. The process for producing the toner for electrophotography according to claim 1, wherein the aggregating agent concentration Ec in said (3) modifying satisfies formula 2-1:

$$0.08 < Ec/Ea \leq 0.30 \quad \text{(formula 2-1).}$$

3. The process for producing the toner for electrophotography according to claim 1, wherein the aggregating agent concentration Ec in said (3) modifying satisfies formula 2-2:

$$0.005 \leq Ec/Ea \leq 0.08 \quad \text{(formula 2-2).}$$

4. The process for producing the toner for electrophotography according to claim 1, wherein each of the resin particles in the resin particle dispersion (a) and the resin microparticles in the resin microparticle dispersion (b) comprises a polyester.

5. The process for producing the toner for electrophotography according to claim 1, which further comprises, before said (4) heating, adding, to the resin microparticle-deposited aggregated particle dispersion (C) produced in said (3) modifying and having the aggregating agent concentration Ec, an aggregation-terminating agent represented by formula (3):

$$R—O—(CH_2CH_2O)_nSO_3M \quad (3)$$

wherein R represents an alkyl group, M represents a monovalent cation, and n represents an average molar number of addition of 0 to 15.

6. The process for producing the toner for electrophotography according to claim 1, wherein said (3) modifying comprises:

(3-1) maintaining the dispersion (B) of resin microparticle-deposited aggregated particles produced in said (2) adding at a temperature which is equal to or higher than (Tg−10° C.) of an amorphous polyester (b), wherein Tg presents glass transition point, present in the resin microparticles in the resin microparticle dispersion (b), to thereby produce a core/shell particle dispersion (1) having an aggregating agent concentration of 0.05 to 0.40 mol/L and a particle circularity of 0.920 to 0.970; and (3-2) removing at least a part of the aggregating agent from the core/shell particle dispersion (1) produced in said (3-1) maintaining, to thereby produce a dispersion (C) of resin microparticle-deposited aggregated particles having the aggregating agent concentration Ec, and a core/shell particle dispersion (3) having a particle circularity of 0.950 to 0.980 is produced after coalescence performed in said (4) heating, wherein the circularity of the particles present in the core/shell particle dispersion (3) is greater by 0.005 or more than that of the particles present in the core/shell particle dispersion (1).

7. The process for producing the toner for electrophotography according to claim 6, wherein said (3-2) removing comprises (3a) removing at least a part of the aggregating agent and the aqueous medium from the core/shell particle dispersion (1), to thereby form a slurry, and an aqueous medium is added to the slurry.

8. The process for producing the toner for electrophotography according to claim 7, wherein said (3-2) removing further comprises, after a first addition of the aqueous medium in said (3a) removing, (3b) in which said (3a) removing is repeated one or more times.

9. The process for producing the toner for electrophotography according to claim 6, wherein the aggregating agent concentration Ec of the resin microparticle-deposited aggregated particle dispersion (C) produced in said (3-2) removing is 0.2 times or less the aggregating agent concentration Ec of the core/shell particle dispersion (1) produced in said (3-1) maintaining.

10. The process for producing the toner for electrophotography according to claim 6, wherein the dispersion (B) is maintained in said (3-1) maintaining at a temperature which is equal to or higher than a temperature lower by 5° C. than a glass transition point of the resin microparticles present in the resin microparticle dispersion (b).

11. The process for producing the toner for electrophotography according to claim 6, wherein the particles present in the core/shell particle dispersion (1) produced in said (3-1) maintaining have a BET specific surface area of 4.0 $m^2/g$ or more and less than 14.0 $m^2/g$, and the particles present in the core/shell particle dispersion (3) produced in said (4) heating have a BET specific surface area of 1.0 $m^2/g$ or more and less than 4.0 $m^2/g$.

12. The process for producing the toner for electrophotography according to claim 6, wherein the amorphous polyester (b) has a glass transition point of 55 to 75° C.

13. The process for producing the toner for electrophotography according to claim 1, wherein the resin particle dispersion (a) comprises colorant-containing resin particles comprising a colorant.

14. The process for producing the toner for electrophotography according to claim 1, wherein the aggregating agent is a monovalent salt.

15. The process for producing the toner for electrophotography according to claim 14, wherein the monovalent salt is a water-soluble nitrogen-containing compound having a molecular weight of 350 or less.

16. The process for producing the toner for electrophotography according to claim 15, wherein the pH value of an aqueous solution containing 10% by weight of the water-soluble nitrogen-containing compound is 4 to 6, as measured at 25° C.

* * * * *